US006110095A

United States Patent [19]

Finke et al.

[11] Patent Number: 6,110,095

[45] **Date of Patent: *Aug. 29, 2000**

[54] APPARATUS FOR HEATING CORRUGATED PAPERBOARD

[75] Inventors: Joseph L. Finke, Street; Kent W. Thurston, Timonium; Gary S. Podhorniak, Baltimore; Charles E. Thomas, Reisterstown, all of Md.

[73] Assignee: United Container Machinery Inc., Glen Arm, Md.

[ * ] Notice: This patent issued on a continued prosecution application filed under 37 CFR 1.53(d), and is subject to the twenty year patent term provisions of 35 U.S.C. 154(a)(2).

[21] Appl. No.: 08/892,694

[22] Filed: Jul. 15, 1997

Related U.S. Application Data

[60] Provisional application No. 06/044,640, Apr. 18, 1997.

[51] Int. Cl.[7] ..... B31F 1/28; B31F 1/20

[52] U.S. Cl. ..... 493/463; 34/624; 34/629; 34/638; 156/470

[58] Field of Search ..... 493/381, 463, 493/467; 156/470–73, 497, 499, 462; 226/92; 165/89; 34/120, 624, 629, 638, 115, 114

[56] References Cited

U.S. PATENT DOCUMENTS

| | | | |
|---|---|---|---|
| 2,828,553 | 4/1958 | Jarosz . | |
| 3,175,300 | 3/1965 | Nitchie | 34/549 |
| 3,226,840 | 1/1966 | Moser | 34/624 |
| 3,319,353 | 5/1967 | Matsunami et al. | 34/634 |
| 3,340,125 | 9/1967 | Drenning et al. | 156/274 |
| 3,434,901 | 3/1969 | Griffiths et al. | 156/210 |
| 3,591,908 | 7/1971 | Pepmeier | 156/497 |
| 3,654,032 | 4/1972 | Kruglinski et al. | 156/470 |
| 3,981,758 | 9/1976 | Thayer et al. | 156/470 |
| 3,995,553 | 12/1976 | Winterholler et al. | 226/92 |
| 4,071,392 | 1/1978 | Chaudhuri | 156/470 |
| 4,103,434 | 8/1978 | Walker | 34/114 |
| 4,161,269 | 7/1979 | Kirkpatrick | 226/92 |
| 4,202,723 | 5/1980 | Chaudhuri | 156/470 |
| 4,268,341 | 5/1981 | Huhne | 156/470 |
| 4,310,375 | 1/1982 | Seki | 156/462 |
| 4,338,154 | 7/1982 | Berthelot et al. | 156/462 |
| 4,348,250 | 9/1982 | Bromley | 156/473 |
| 4,381,212 | 4/1983 | Roberts | 156/497 |
| 4,419,173 | 12/1983 | Akiyama et al. | 156/470 |
| 4,459,726 | 7/1984 | O'Brien et al. | 165/89 |
| 4,483,770 | 11/1984 | Casey et al. | 34/640 |
| 4,556,444 | 12/1985 | Schommler | 156/470 |

(List continued on next page.)

FOREIGN PATENT DOCUMENTS

| | | |
|---|---|---|
| 6270299 | 9/1994 | Japan . |
| WO 9816372 | 4/1998 | WIPO . |

*Primary Examiner*—Peter Vo
*Assistant Examiner*—James P. Calve
*Attorney, Agent, or Firm*—Biebel & French

[57] ABSTRACT

An apparatus and related method for forming a double face paperboard web are disclosed. The apparatus of the present invention includes a heating section upstream from a drawing section. The heating section includes at least one heating plate having an upper surface facing a paperboard web and heated by a plurality of primary channels supplied with steam. A plurality of secondary channels extend through the heating plate intermediate the primary channels and a lower surface of the plate. A plurality of outlet ports communicate with each secondary channel and the upper surface of the heating plate. Steam supplied to the secondary channels exits through the outlet ports thereby producing a steam film between the upper surface of the heating plate and the lower surface of the paperboard web. The steam film substantially reduces frictional forces opposing movement of the web while also dramatically increasing the heat transfer to the paperboard web and accelerating the gelatinization of the glue therein. A weight blanket is provided for exerting pressure against the upper surface of the web. A plurality of fluid ports are formed within the weight blanket for producing a steam film between the weight blanket and the web for, again, reducing frictional contact with the web while improving heat transfer thereto.

30 Claims, 17 Drawing Sheets

U.S. PATENT DOCUMENTS

| | | | |
|---|---|---|---|
| 4,764,236 | 8/1988 | Nikkel | 156/470 |
| 4,819,557 | 4/1989 | Handschuher | 226/92 |
| 4,833,794 | 5/1989 | Stibbe | 34/156 |
| 4,836,429 | 6/1989 | Nakashima et al. | 226/7 |
| 4,889,580 | 12/1989 | Seki et al. | 156/470 |
| 4,917,664 | 4/1990 | Lacaux | 493/463 |
| 4,932,139 | 6/1990 | Lehtinen | 34/624 |
| 4,947,559 | 8/1990 | Basler et al. | 34/116 |
| 5,156,714 | 10/1992 | Thomas | 156/472 |
| 5,181,330 | 1/1993 | Schoch | 34/659 |
| 5,183,525 | 2/1993 | Thomas | 156/470 |
| 5,249,373 | 10/1993 | Rogne et al. | 34/120 |
| 5,256,240 | 10/1993 | Shortt | 156/470 |
| 5,259,124 | 11/1993 | Poterala | 34/638 |
| 5,333,771 | 8/1994 | Cesario | 226/92 |
| 5,419,796 | 5/1995 | Miller | 156/472 |
| 5,456,783 | 10/1995 | Sissons | 156/470 |
| 5,466,329 | 11/1995 | Marschke | 156/470 |
| 5,480,086 | 1/1996 | Nakashima et al. | 226/97 |
| 5,495,092 | 2/1996 | Marschke et al. | 156/470 |
| 5,501,762 | 3/1996 | Marschke et al. | 156/470 |
| 5,526,739 | 6/1996 | Lauderbaugh et al. | 100/154 |
| 5,539,997 | 7/1996 | Teschner | 34/611 |
| 5,561,918 | 10/1996 | Marschke | 34/629 |
| 5,578,160 | 11/1996 | Krznarich et al. | 156/462 |
| 5,614,048 | 3/1997 | Barny et al. | 156/471 |
| 5,628,865 | 5/1997 | Marschke | 156/473 |
| 5,630,903 | 5/1997 | Knorr et al. | 156/471 |
| 5,632,830 | 5/1997 | Marschke | 156/470 |
| 5,647,141 | 7/1997 | Hanaya | 34/115 |
| 5,656,124 | 8/1997 | Krayenhagen et al. | 156/470 |
| 5,766,410 | 6/1998 | Wu | 156/472 |
| 5,788,803 | 8/1998 | Sissons | 156/470 |

APPARATUS FOR HEATING CORRUGATED PAPERBOARD

CROSS-REFERENCE TO RELATED APPLICATION

This application claims the benefit of U.S. Provisional Application No. 60/044,640, filed Apr. 18, 1997.

BACKGROUND OF THE INVENTION

1. Field of the Invention

The present invention relates to a method and apparatus for processing corrugated paperboard, and more particularly, to a method and apparatus for producing a heated fluid film between a heating plate a paperboard web.

2. Description of the Prior Art

The manufacturing of double face corrugated paperboard typically begins with an apparatus known as a single facer. A conventional single facer includes an upper corrugating roll and a lower corrugating roll wherein each roll has a plurality of longitudinally extending teeth. The corrugating rolls are rotatably mounted adjacent each other such that the teeth of each roll are in a meshing relationship. A medium web typically passes through a preheater for conditioning and is then fed into the nip point of the upper and lower corrugating rolls wherein the medium web conforms to the contour of the meshing teeth to form flutes in the medium web.

To preheat the medium web, the preheater typically comprises a steam pressurized drum heater having an internal cavity supplied with steam from an external source. The medium web is wrapped around the circumference of the drum and heat from the surface of the drum is transferred to the moving medium web.

A gluing roll, arranged to turn in a bath of starch-based glue, applies glue to the tips of the medium web flutes. A top liner web is simultaneously supplied to a preheater of similar design to the medium web preheater.

Both the top liner web and medium web preheaters depend on conduction for heat transfer to the respective paperboard web. Conduction heat transfer is directly related to the surface area of the paperboard web contacting the preheater and the duration of such contact. In order to provide sufficient heat transfer, the preheaters must therefore define a relatively large surface area and the processing speed of the single facer must be limited. The large surface area required of prior art preheaters substantially increases the overall size of the single facer. In fact, such preheaters are often so large that the preheater must be placed exterior to, and many times behind, the corrugating apparatus. Further, frictional forces opposing the movement of the top liner and medium webs are substantially increased the greater the surface area contacting the webs. Such frictional forces generate tension within the webs, often resulting in web breakage. Prior art attempts to eliminate such problems generated by friction have resulted in complex mechanical arrangements including rotatable preheater drums and variable wrap mechanisms.

The conventional single facer further includes a pressure roll arranged adjacent the lower corrugating roll to apply a nip pressure to the corrugated medium web and the top liner web. The pressure roll and lower corrugating roll are typically heated and the combination of heat and pressure gelatinizes the glue between the medium web and top liner web thereby forming a single face web of corrugated paperboard.

The glue applied to the flutes of the paperboard webs is typically a suspension of raw or uncooked starch in a suitable liquid carrier. In this state, the starch has little or no adhesive qualities. However, at a certain temperature, dependent upon the type of starch utilized and the kind and amount of additives dissolved in the carrier, the starch granules will absorb the liquid of suspension available and swell, causing gelatinization of the suspension. In this state the starch has superior adhesion abilities and will form a good bond between many substrates, including paper. The temperature at which gelatinization occurs for any particular formulation of glue can be easily determined by heating the particular formulation and observing the changes that occur in its viscosity.

After passing over a single face web preheater drum of design similar to the medium web and top liner preheaters, the single face web is next conveyed to a gluing station where the exposed flute tips are covered with a starch-based glue. A bottom liner is typically trained over a preheater in a manner similar to the single face web and then brought into contact with the glued flute tips of the single face web by an apparatus called a double facer to produce a double face web of corrugated paperboard. In order to heat the bottom liner and assist in the gelatinization of the glue between the bottom liner and single face web, the double face web is pressed against and conveyed over an array of heating plates arranged in the direction of web movement. The heating plates define a heating section of the double facer and are typically comprised of cast iron and have central chambers for containing pressurized steam. Inlet and outlet ports in the lower surface of the heating plates provide for the continuous flow of steam.

Double face web travel over the heating plates is conventionally provided by a driven holddown means, usually a continuous holddown belt, in direct contact with the top liner. A series of ballast rollers or the like bear on the inner surface of the holddown belt such that pressure is maintained between the holddown belt and the top liner of the double face web thereby facilitating thermal contact between the web and heating plates.

The conventional double facer apparatus and related method as described above have many inherent disadvantages. For example, since the paperboard is heated by conduction through surface contact between the bottom liner web and top surface of the heating plates, significant frictional forces are developed as the double face web is dragged over the heating plates. Further, if the conventional driven holddown belt is replaced by holddown means having a stationary surface for contacting and holding the web against the heating plates, then additional frictional forces are generated between the top liner and the lower surface of the holddown means as the web is pulled through the double facer by a downstream drawing section. These combined frictional forces result in more horsepower being required to pull the web over the heating plates.

Since the frictional force generated by the web movement is directly proportional to the normal force exerted on the board in the heating section, the pressures in the heating section are deliberately kept much lower than the crush strength of the board in order to avoid even greater horsepower requirements. This, however, results in a reduced heat transfer rate and in turn necessitates a long heating section, typically of forty feet or more. Although the purpose of applying heat to the bottom liner is to raise the temperature of the glue, the glue is actually insulated from the heat source by the bottom liner, resulting in inefficient heat transfer. The prior art process relies on conduction as the primary mode of heat transfer and paper is inherently a poor thermal conductor. In situations where double or triple wall board is being formed, i.e., layers of liners spaced apart by alternating layers of medium, this problem is even more acute since the glue is then insulated by additional layers of liner and medium.

With regard to the quality of the paperboard produced in the conventional process, several common defects in corrugated paperboard are readily traced to the bonding operation in the conventional double facer heating section. For example, warpage of the board is common because of the bonding of a single face web and bottom liner web possessing different moisture levels. After bonding, both webs approach an equilibrium level of moisture content thereby causing differential movement of the two webs, resulting in warpage of the bonded double face web. Additionally, since the boards must be dragged in contacting relationship over the heating plates, some scuffing of the bottom liner will inevitably occur. While this will usually not be serious enough to cause board reject, it does make preprinting of the bottom liner difficult and may necessitate printing of each of the subsequently formed paperboard blanks on an individual basis.

Even with a double facer having a heating section of forty feet or more, the corrugating process speed must be kept fairly low due to poor thermal transfer in the heating section. Additionally, the high frictional forces developed between the web and the heating plates or stationary holddown means result in increased board tensions and a higher frequency of web breakage or tear-outs.

Accordingly, there is a need for a method and apparatus for heating corrugated paperboard which does not generate significant frictional forces against a moving paperboard web and which improves the glue curing times between a medium web and a liner web.

Another problem associated with conventional double facers relates to the process of feeding and threading a web through the heating section in preparation for continuous web processing. The prior art method essentially comprises a "brute force" process of human operators gripping each side of a bottom liner web and then manually pulling the liner web downstream between the heating plates and the holddown means. If a downstream drawing section is utilized for pulling the web through the heating section, then the operators must pull the leading edge of the web through the entire length of the heating section, typically 40 feet or more, and into engagement with the conveying elements of the drawing section. Glued flute tips of the single face web are then manually brought into contact with the bottom liner. Upon start-up of the double facer, the drawing section pulls the bottom liner and single face web through the heating section.

As is readily apparent, the prior art threading process is both difficult and time consuming. Further, the traditional threading process creates significant safety concerns. The operators must manually feed the web through pressure nips defined to receive the paperboard web, resulting in crushing hazards for the hands and fingers of the operators. Additionally, if the double facer has been operating, the process is further complicated by extremely hot components, particularly the surface of the heating plates. Operators must come into close proximity with these hot components during the threading process resulting in the possibility of serious burns being inflicted upon the bodies of the operators.

Accordingly, there is a need for a method and apparatus for threading a web in an safe and efficient manner through a web processing machine. In particular, there is a need for such a method and apparatus for threading a web through the heating section and drawing section of a double facer.

SUMMARY OF THE INVENTION

The present invention provides a method and apparatus for processing corrugated paperboard and, more particularly, for forming a double face web. While the heating plates of the present invention may be utilized in any number of locations along a typical corrugating line, it is particularly well-suited for use as a single facer preheater, as a preheater immediately preceding a double facer, or as a heating unit within a double facer. The method of the present invention includes the steps of providing at least one heating plate having an upper surface facing a web, heating the upper surface of the plate, generating a steam film between the upper surface and the web, at least partially supporting the web on the steam film, and conveying the web over the heating plate whereby the steam film lubricates the web from frictional forces while simultaneously transferring heat to the web. Preferably, the steam film is in fluid communication with a low pressure steam supply through a plurality of apertures formed within the upper surface of the plate.

The present invention further provides a heating apparatus comprising a heating section including at least one heating plate having an upper surface and a lower surface. Each heating plate has a plurality of parallel primary channels extending from one end of the plate to an opposite end. The primary channels are proximate to the upper surface of the plate, thereby forming a thin web of material between the channels and the upper surface, and a thick web of material between the primary channels and the lower surface of the plate to thereby rigidify the plate. Adjacent pairs of primary channels are interconnected at alternate ends to form a continuous serpentine passageway parallel to the upper surface of the plate. The heating plate further includes at least one high pressure steam inlet port and at least one high pressure condensate return port communicating with the continuous serpentine passageway. High pressure steam is supplied to the high pressure steam inlet port by an external source, travels through the continuous serpentine passageway of primary channels, and then exits through the high pressure condensate return port. The high pressure steam within the primary channels transfer heat to the upper surface of the plate by way of conduction through the thin web of material between the channels and the upper surface.

A plurality of secondary channels are provided intermediate the primary channels and the lower surface of the heating plate. The secondary channels extend parallel to the primary channels from one end of the plate to an opposite end and include a plurality of outlet ports in communication with the upper surface of the heating plate. Each secondary channel is sealed from the other channels and has a low pressure steam inlet port through which low pressure steam is supplied from an external source. The low pressure steam travels to the upper surface of the plate through the secondary channels and fluid ports while being heated through heat conduction from the high pressure steam within the primary channels. In the preferred embodiment of the invention, the low pressure steam is superheated prior to being released through the fluid ports.

A steam film is produced between the upper surface of the heating plate and the lower surface of the paperboard web thereby substantially reducing, if not eliminating, frictional forces between the heating plate and the paperboard web. An unexpected and significant result is that the steam film dramatically increases the heat transfer to the paperboard web thereby accelerating gelatinization of glue within the paperboard web.

A further embodiment of the present invention provides for a holddown device comprising a weight blanket supported above the heating plates for exerting pressure against the web. The weight blanket includes a plurality of interconnected rigid shoes arranged in a plurality of laterally, or cross machine, extending rows wherein the shoes of each row are offset from the shoes of an adjacent row. A plurality of longitudinally extending cables interconnect the plurality of rows of shoes. Vertically moveable support members are connected to and support the upstream and downstream ends of the cables. Linear actuators are operably connected to the support members for raising and lowering the weight blanket thereby varying the portion of the weight blanket exerting pressure against the web. Further, the weight blanket may be fully elevated to provide clearance for threading the web, maintaining the heating plates or similar operation.

The shoes collectively define a lower surface of the weight blanket facing the upper surface of the paperboard web. Each shoe includes at least one fluid port in communication with a heated fluid supply thereby producing a heated fluid film between the upper surface of the paperboard web and the lower surface of the weight blanket. The weight blanket is at least partially supported by the heated fluid film thereby lubricating the web from frictional contact with the lower surface of the weight blanket. The heated fluid film preferably comprises a dry steam film in fluid communication with a low pressure steam supply through the fluid ports of the rigid shoes.

In the preferred embodiment of the present invention, the fluid ports of both the secondary channels and rigid shoes are arranged to form predetermined zones. Each zone of fluid ports is connected to an independently controllable manifold such that a plurality of steam film zones are defined throughout the steam film. Depending upon paperboard quality problems, any one of a number of combined fluid film zones may be obtained by selectively activating the various manifolds or altering the properties of the steam supplied to each manifold. Steam film zones of different pressure result in selected areas of reduced friction which counteract and balance the tensions resulting within the paperboard web. Alternatively, steam film zones of different temperatures result in selected areas of paperboard with different glue curing times. By using steam in one zone and air in another zone, the curing time of the glue between the medium and liner may be further controlled. In addition, by selectively controlling the fluid film zones acting upon the top or bottom liners of a double face web, differences between the tensions and moisture contents in the top and bottom liners may be corrected.

A drawing section is provided downstream from the heating section for pulling the paperboard web over the heating plates. The drawing section comprises upper and lower opposing conveyor belts for engaging upper and lower surfaces of the web. Linear actuators support the upper conveyor belt above the lower conveyor belt wherein activation of the linear actuators raises and lowers the upper conveyor belt relative to the lower conveyor belt.

The apparatus of the present invention further includes a threading device for gripping the paperboard web and pulling a leading edge of the web over the heating plates. The threading device comprises a pair of flexible conveyor elements extending longitudinally along each side of the heating plates. A gripping device is connected to and supported between the conveyor elements for securing the web thereto. A drive is operably connected to the conveyor elements for moving the gripping device and web over the heating plates.

The gripping device comprises a threader bar extending between the conveyor elements. Similarly, a pinch bar extends between the conveyor elements and cooperates with the threader bar. The pinch bar is mounted for pivotal movement relative to the threader bar for engaging and securing the web between the pinch bar and the threader bar. During a normal mode of operation the pinch bar is spring biased towards the threader bar, while during a set-up mode of operation the pinch bar is biased away from the threader bar.

The method of threading a web through the apparatus of the present invention includes the steps of wrapping a leading edge of the web around a portion of the outer surface of the threader bar, and then pivoting the pinch bar towards said threader bar thereby securing the web between the pinch bar and the threader bar. The conveyor elements are next driven in motion wherein the threader bar, pinch bar and web are transported downstream through the apparatus. After stopping the conveyor elements, the pinch bar is pivoted away from the threader bar thereby releasing the web from between the pinch bar and the threader bar. The leading edge of the web is unwrapped from the outer surface of the threader bar leaving the web threaded through the web processing apparatus and ready for continuous processing.

Therefore, it is an object of the present invention to provide an apparatus and method for heating a corrugated paperboard web which does not produce significant frictional forces acting upon the web.

It is a further object of the present invention to provide such a heating apparatus and method for improving glue curing times of a corrugated paperboard web.

It is yet another object of the present invention to provide such a heating apparatus of simple design.

It is a further object of the present invention to provide such a heating apparatus and method having increased thermal efficiency.

It is another object of the present invention to provide such a heating apparatus and method generating a steam film above a heating plate wherein the steam film at least partially supports a paperboard web.

It is an additional object of the present invention to provide such a steam film between the upper surface of a paperboard web and a holddown device.

It is a further object of the present invention to provide a heating apparatus and method generating independently controllable zones of heated fluid film for reducing frictional forces upon the paperboard web.

It is still another object of the invention to provide a safe and efficient apparatus and method for threading a paperboard web through a web processing machine.

It is yet another object of the invention to provide such a threading apparatus which securely grips a paperboard web and pulls the web downstream through a web processing machine with minimal human intervention.

It is a further object of the invention to provide such a threading apparatus for pulling a paperboard web through the heating section and into the drawing section of a double facer.

Other objects and advantages of the invention will be apparent from the following description, the accompanying drawings and the appended claims.

DETAILED DESCRIPTION OF THE PREFERRED EMBODIMENT

Figure 1:
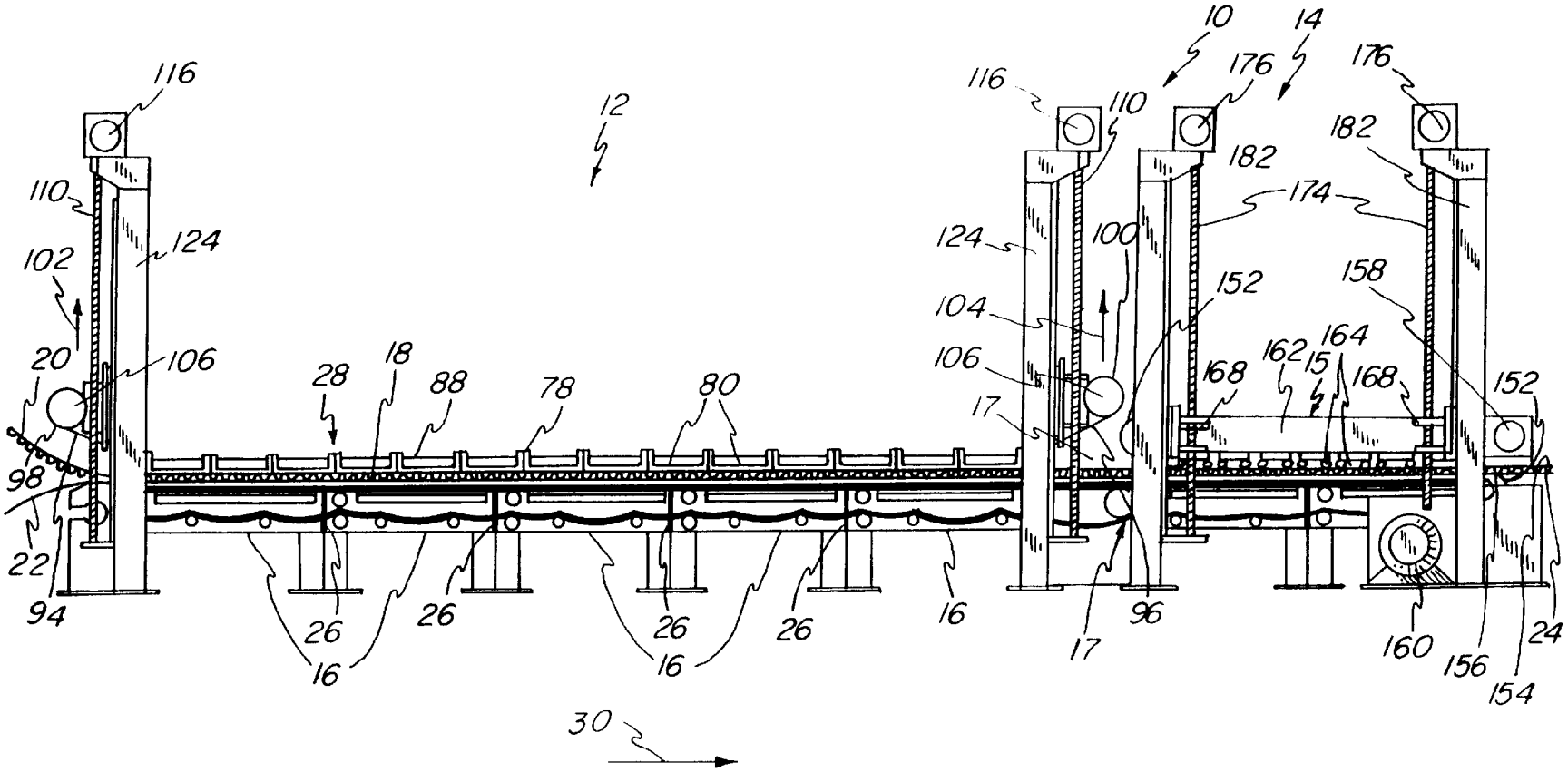
FIG. 1 is a side elevational view of a web processing apparatus of the present invention.
Figure 2:
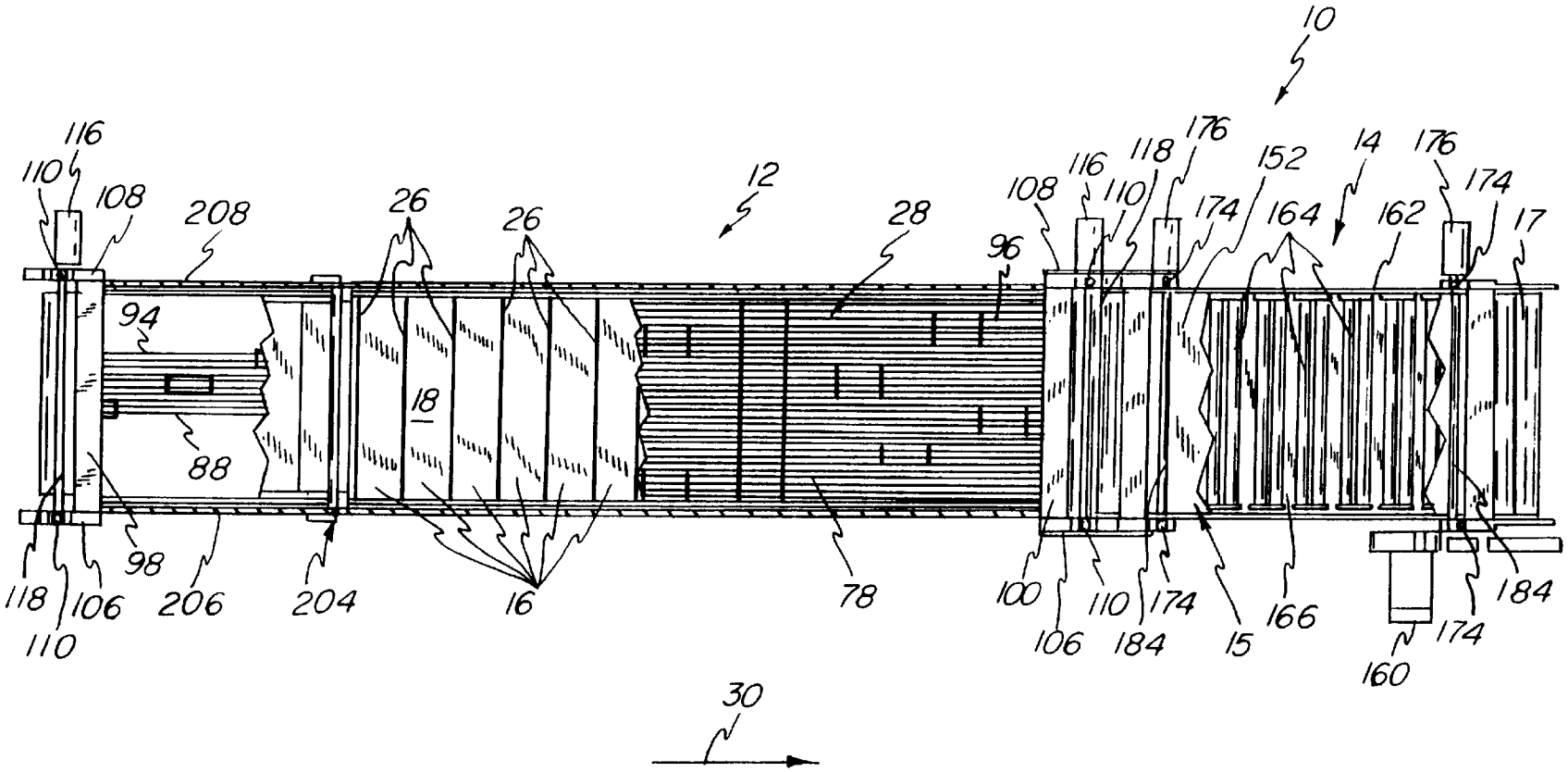
FIG. 2 is a top plan view of the web processing apparatus of FIG. 1 with a partial cutaway of the weight blanket and the upper conveyor belt.
Figure 3:
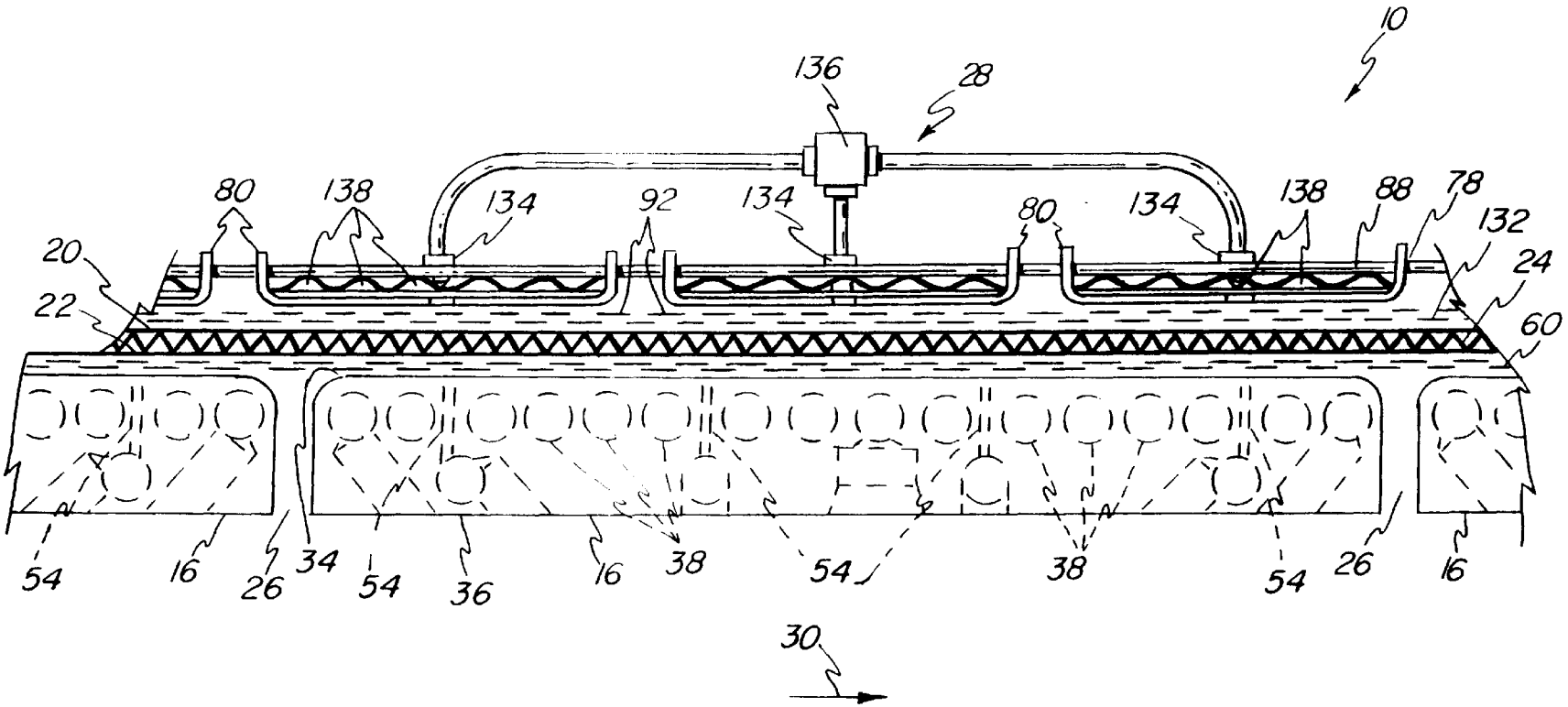
FIG. 3 is a partial side elevational view of the double facer of FIG. 1.

Referring initially to FIGS. 1–3, a double facer 10 constructed in accordance with the preferred embodiment of the present invention is shown as including a heating section 12 upstream from a drawing section 14. The heating section 12 includes a plurality of heating plates 16 arranged in a side-by-side array such that they define a heated surface 18 over which a single face web 20, having a starch-based adhesive applied to its exposed flute tips, is brought together with a bottom liner web 22 to form a double face corrugated web 24. Each heating plate 16 has a width in the cross-machine or lateral direction of approximately 100 inches and a length in the longitudinal direction of approximately 24 inches. The plates 16 are typically arranged to provide a heated surface 18 of approximately 40 feet in length while each plate 16 is spaced apart such that a gap 26 of approximately 1 inch is provided between adjacent heating plates 16 (FIG. 2). A holddown device 28 is provided above the heating plates 16 for forcing the single face web 20 towards the liner web 22 and heated surface 18 defined by the heating plates 16.

The double face web 24 is conveyed through the heating section 12, in the direction of arrow 30, by the drawing section 14. While, FIGS. 1 and 2 illustrate a drawing section 14 including upper and lower conveyor belts, 15 and 17, respectively, it is to be understood that any suitable conveying elements may be used within the drawing section 14 of the present invention. For example, the drawing section 14 may be of the type disclosed in U.S. patent application Ser. No. 08/838,150 filed Apr. 15, 1997 entitled "Web Conveyor" and assigned to the assignee of the present invention.

Figures 4, 5:
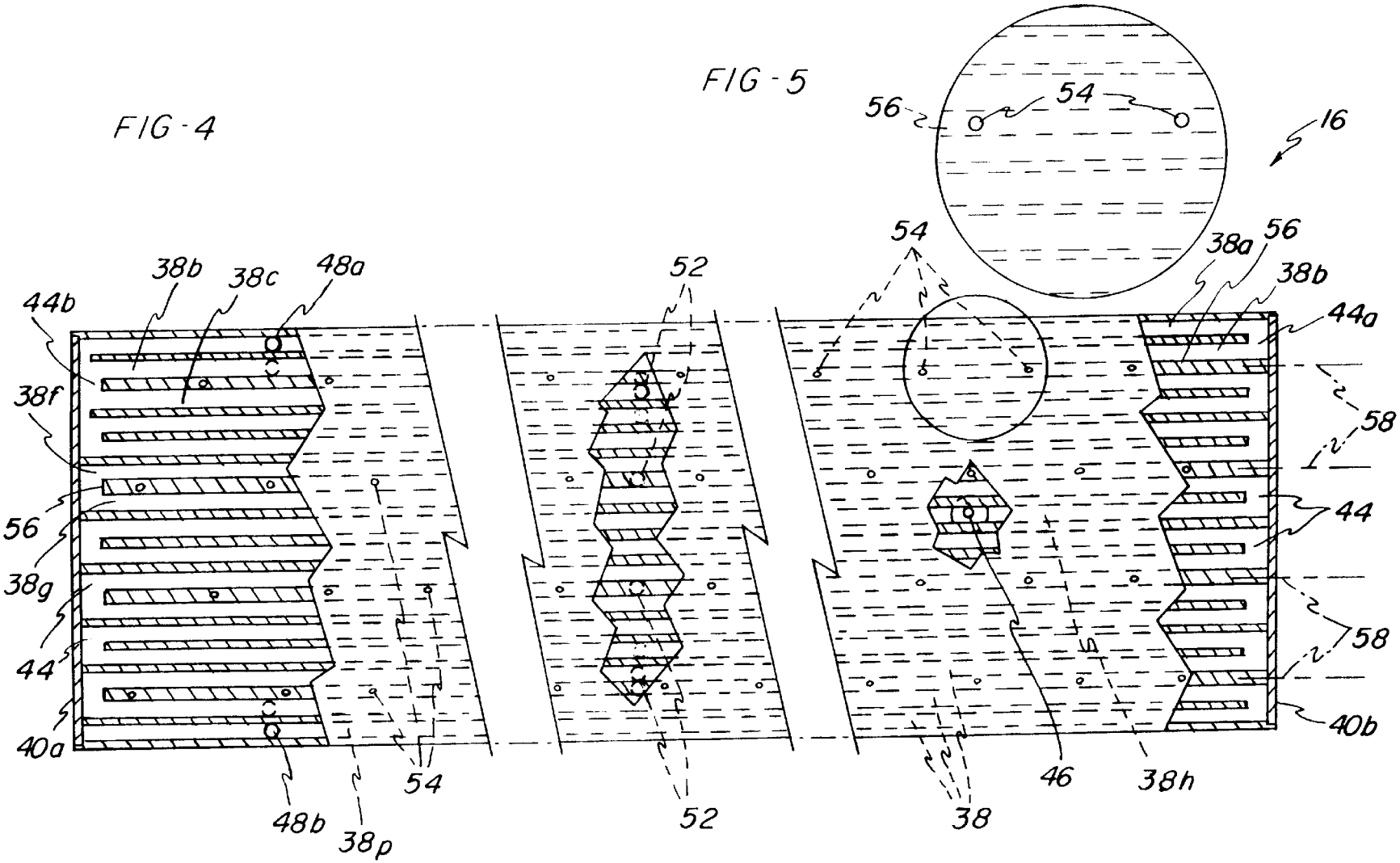
FIG. 4 is a top plan view of the heating plate of the present invention as used in the apparatus of FIG. 1, where the heating plate is partially broken away to show the internal structure.
FIG. 5 is a top detail view of the heating plate of FIG. 4.
Figure 6:
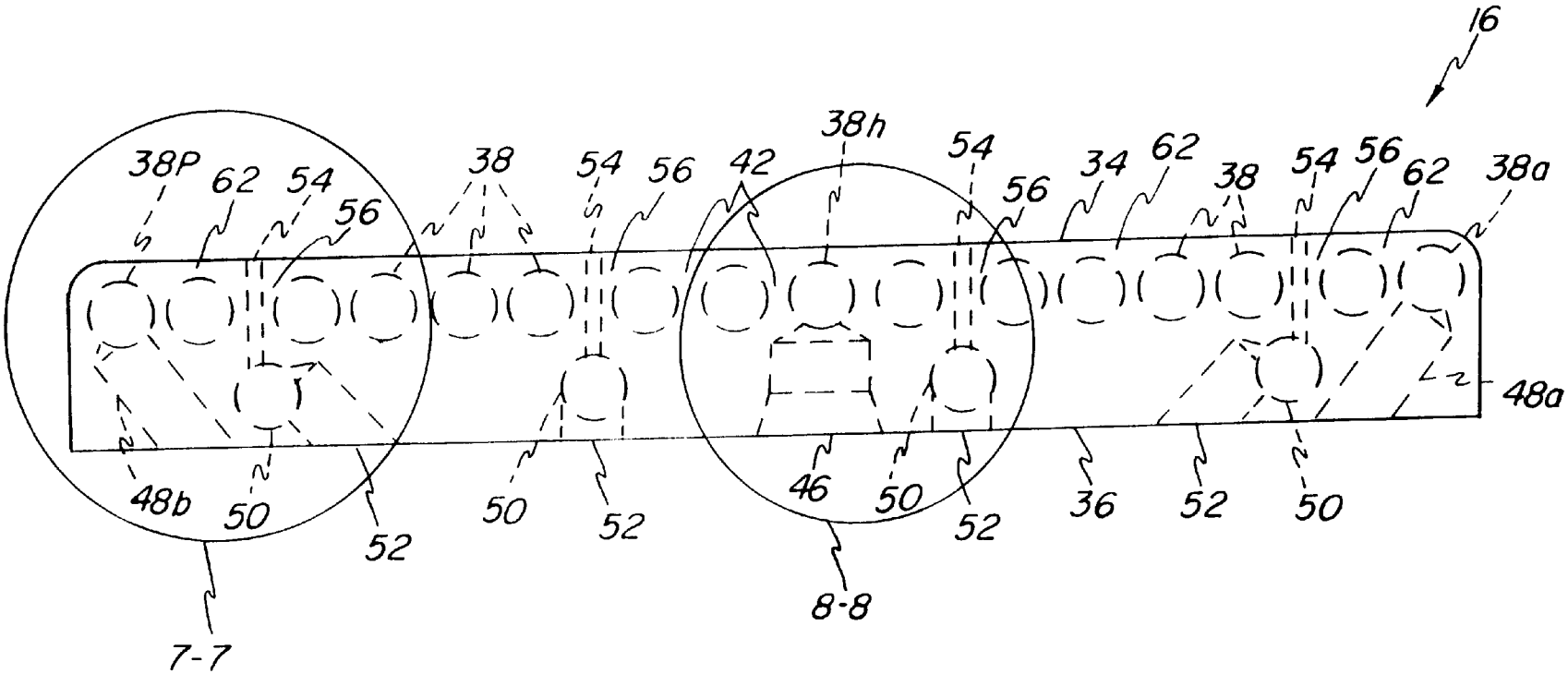
FIG. 6 is an side elevational view of the heating plate shown in FIG. 4.
Figure 7:
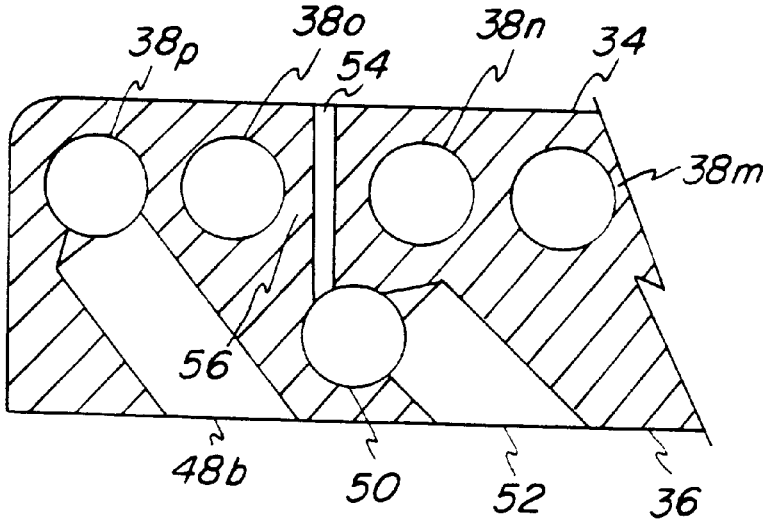
FIG. 7 is a detail view taken along line 7—7 in FIG. 6.
Figure 8:
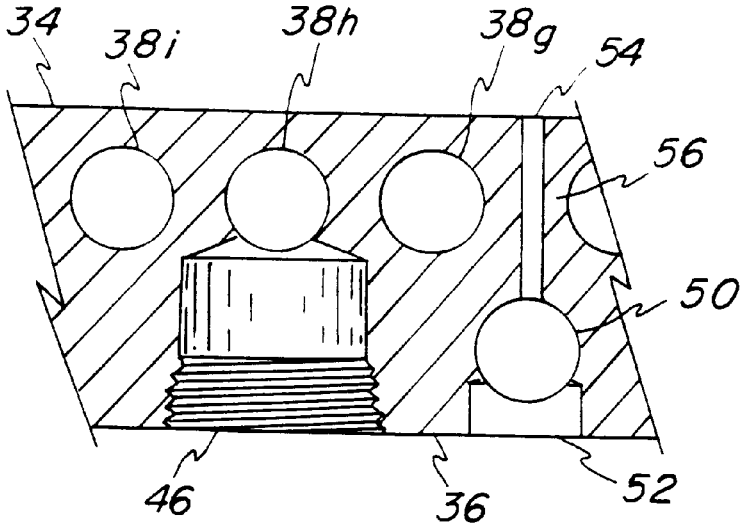
FIG. 8 is a detail view taken along line 8—8 in FIG. 6.

Turning now to FIGS. 3–6, the heating plates 16 will be described in greater detail. Each heating plate 16 includes an upper or heated surface 34 facing the liner web 22 and a lower or remote surface 36 facing away from the liner web 22. A heating element defined by a plurality of primary channels 38 extend between side faces 40*a* and 40*b* of the plate 16. As shown in FIGS. 3 and 6, the primary channels 38 are cylindrical in nature thereby forming hourglass-shaped walls 42 between adjacent primary channels 38. Slots 44 are included at alternate opposite ends to interconnect adjacent primary channels 38 to form a serpentine path through the plate 16. While the primary channels, walls and slots are referred to generally by the reference numerals 38, 42 and 44, a particular item will be referred to by the reference numeral in combination with a lower case letter, as more clearly shown in FIGS. 4 and 6.

Referring further to FIG. 4, slot 44*a* is included at side 40*b* of the plate 16 to interconnect the first two primary channels 38*a* and 38*b*. At the opposite side 40*a*, slot 44*b* interconnects the second and third primary channels 38*b* and 38*c*. Each pair of adjacent primary channels 38 are interconnected at alternate ends to form a serpentine path through the plate 16.

With further reference to FIGS. 4–8, the heating plate 16 further includes a high pressure steam inlet port 46 located intermediate the side faces 40*a* and 40*b* to intersect with primary channel 38*h* from the lower surface 36 of the plate 16 for supplying high pressure steam from an external source. The plate 16 further includes a first high pressure condensate return port 48*a* communicating with primary channel 38*a*, and a second high pressure condensate return port 48*b* communicating with primary channel 38*p*. As the high pressure steam inlet port 46 is located intermediate the side faces 40*a* and 40*b*, the high pressure steam flow is bi-directional within the channel 38*h*, and a portion of the steam will travel through the serpentine path in the plate 16 and exit through port 48*a*, while the remainder of high pressure steam flows in the opposite direction within channel 38*h* and exits through the return port 48*b*.

The heating plate 16 further includes a plurality of secondary channels 50 extending parallel to the primary channels 38 between side faces 40*a* and 40*b*, and located intermediate the primary channels 38 and the lower surface 36. The secondary channels 50 are cylindrical in nature and each secondary channel 50 is sealed from the other channels 38 and 50 within the plate 16. As with the primary channels 38, a particular secondary channel 50 will be referred to by a reference numeral in combination with a lower case letter.

Each secondary channel 50 communicates with a low pressure steam inlet port 52 which is centrally located between the side faces 40*a* and 40*b* and which supplies low pressure steam from an external source. The heating plate 16 is constructed such that some primary channels 38 are spaced farther apart from each other than from other primary channels 38 in order to support a plurality of fluid outlet ports 54. For example, channels 38*b* and 38*c*, and channels 38*f* and 38*g*, have a greater center line spacing between each other than other adjacent channels 38 to define a thickened wall 56 therebetween. The plurality of outlet ports 54 extend between the secondary channels 50 and the upper surface 34 of the plate 16 through the thickened wall 56.

The outlet ports 54 are preferably of 0.125 inch diameter and arranged in lines 58 parallel to the secondary channels 50 extending the length of the plate 16. The lines 58 are preferably offset from each other by 6 inches, and the fluid ports 54 of each line 58 are spaced on 6 inch centers such that the fluid ports 54 of each line 58 are offset from the fluid ports 54 of an adjacent line 58. Since the steam inlet port 52 is centrally located within each secondary channel 50, the low pressure steam flow is bi-directional within each channel 50. A portion of low pressure steam flows in the direction of side face 40*a*, while the remainder of steam flows towards side face 40*b*. Heat is transferred from the primary channels 38 through the plate 16 to the secondary channels 50 thereby superheating the low pressure steam traveling therein. The low pressure steam exits through fluid ports 54 to the upper surface 34 of the plate 16.

Turning again to FIG. 3, a steam film 60 is produced between the upper surface 34 and the bottom liner 22 of the double face web 24 by the steam exiting through the outlet ports 54. The steam film 60 supports the web 24 above the heating plates 16 thereby substantially eliminating frictional contact between the heating plates 16 and the double face web 24. A reduction in frictional contact results in less force opposing the movement of the web 24 thereby reducing tension generated within the web 24 and reducing the power required to pull the web 24 through the double facer 10. While it is preferred that the steam film 60 be produced by the outlet ports 54 as described above, it is readily apparent that the steam film 60 may be produced in a number of different ways, including, but not limited to, injecting steam into the gaps 26 between adjacent heating plates 16.

In the preferred embodiment of the invention, both the primary and secondary channels 38 and 50 are formed by drilling through the plate 16 between opposite side faces 40*a* and 40*b*. The primary channels 38 are drilled through the plate 16 proximate the upper surface 34 thereby defining a thin web 62 between the primary channel 38 and the upper surface 34 (FIG. 6). The secondary channels 50 are likewise drilled through the plate 16 but between the primary channels 38 and lower surface 36. The fluid ports 54 are drilled from the upper surface 34 of the plate 16 to intersect the secondary channels 50. Also, in the preferred embodiment, the slots 44 are formed by removing, for example by milling away, portions of the walls adjacent to the end faces 40*a* and 40*b* of the plate 16 (FIG. 4).

Each primary channel 38 is supplied with high pressure saturated steam at approximately 185 psig at 375° F., through its respective inlet port 46, to heat the upper surface 34 of each heating plate 16. While 185 psig is the preferred pressure for the high pressure steam supplied to the primary channels 38, the high pressure steam may possess a pressure within a wide range about 185 psig, but preferably between 160 psig and 200 psig.

Low pressure steam at approximately 0.6 psig is supplied to the inlet port 52 of each secondary channel 50 to form the steam film 60 for supporting the double face web 24 and thereby reducing frictional contact between the web 24 and upper surface 34 of the plate 16. As is readily apparent, the pressure of the low pressure steam within the secondary channels 50 is of several orders of magnitude less than the pressure of the high pressure steam within the primary channels 38. High pressure steam is not appropriate for the secondary channels 50, since such high pressure steam would exit through the outlet ports 54 at a high velocity and cause damaging contact with the web 24. The low pressure steam is preferably within the pressure range of 0.25 psig and 5 psig, the actual pressure selected being directly related to the size and number of outlet ports 54 for producing the steam film 60. More particularly, the steam film 60 must be adequate to support the web 24 wherein the thickness of the steam film 60 is a function of the size and number of outlet ports 54.

The high pressure steam within the primary channels 38 is at a much higher temperature than the low pressure steam within the secondary channels 50. Heat will therefore be transferred through the heating plate 16 from the primary channels 38 to the secondary channels 50, thereby raising the temperature of the low pressure steam. The low pressure steam is consequently superheated by this heat transfer since its pressure remains substantially constant and its temperature is raised above its vapor temperature for that constant pressure.

In the preferred embodiment, however, the low pressure steam is already superheated when it is supplied to the secondary channels 50. More particularly, a saturated steam at a high pressure of approximately 185 psig is throttled by passing the steam through a valve (not shown) thereby reducing the pressure of the steam to approximately 0.6 psig. Throttling causes the temperature of the steam to drop somewhat, but the temperature of the resulting low pressure steam is still higher than that of saturated steam at the corresponding pressure of 0.6 psig (214° F.).

Not only does the superheating increase the internal energy within the low pressure steam and steam film 60 to be transferred as heat to the web 24, but reduces the amount of water density within the steam film 60 so that less water is transferred to the web 24, resulting in fewer water streaks on the bottom liner 22.

It may be appreciated that each secondary channel 50 may be divided into a plurality of sub-channels, each sub-channel being sealed from each other and having an independent low pressure steam inlet port 52. In this manner, steam possessing different properties, i.e. pressure and temperature, may be supplied to each sub-channel and released through that sub-channel's respective fluid ports 54. This will result in the steam film 60 having zones or areas of different properties which may be independently controlled depending upon the desired properties of the resulting paperboard web 24.

Figure 9:
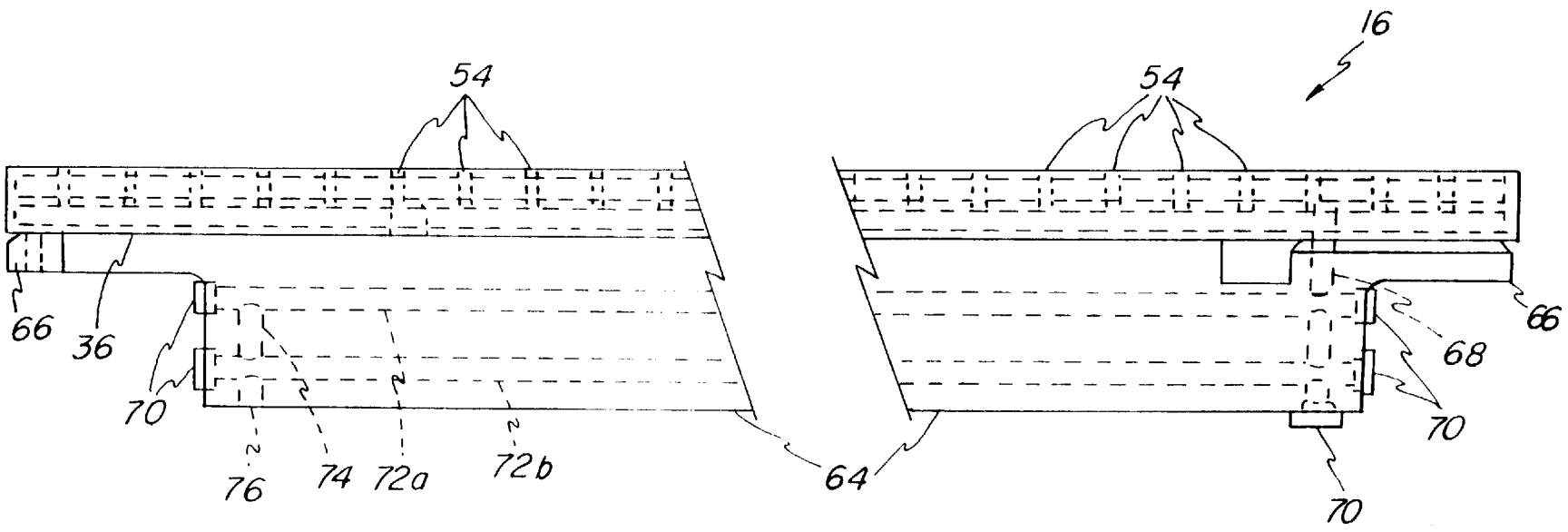
FIG. 9 is a front elevational view of a further embodiment of the heating plate of FIG. 4.
Figure 10:
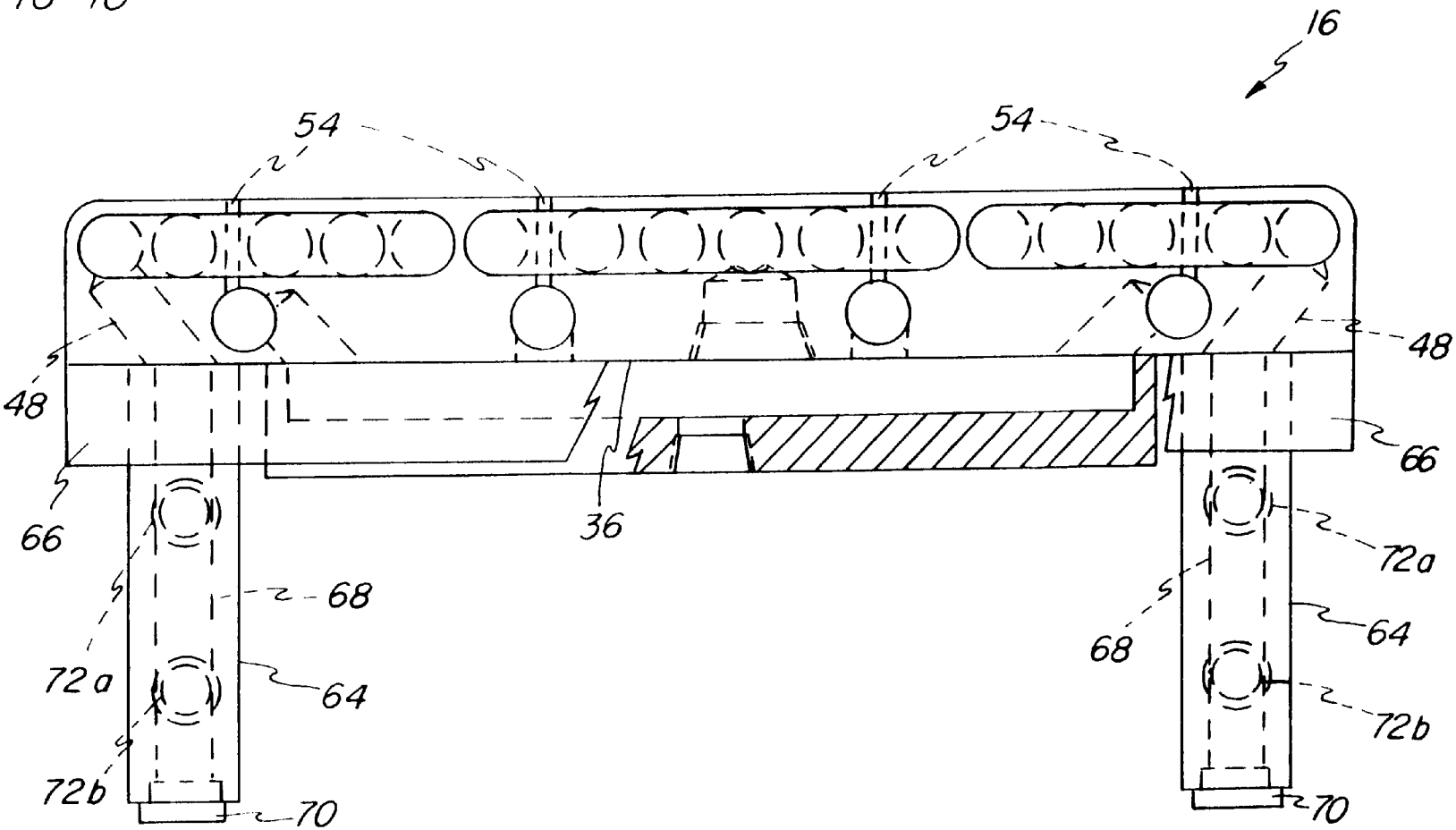
FIG. 10 is a side elevational view of the heating plate shown in FIG. 9 with the end plate removed.

Turning now to FIGS. 9 and 10, the heating plate 16 of the present invention may further include strengthening ribs 64 mounted to the lower surface 36 along the length of the heating plate 16, while strengthening ribs 66 are mounted to the lower surface 36 across the width of the heating plate 16.

The ribs 64 and 66 provide rigidity to the heating plate 16 to prevent thermal distortion due to temperature differences between the upper and lower surfaces 34 and 36.

The ribs 64 include vertical bores 68 positioned in communication with the high pressure condensate return ports 48, where the vertical bores 68 are plugged at their lower ends at 70. Each strengthening rib 64 also includes a pair of longitudinal bores 72*a* and 72*b* intersecting with the vertical bore 68 to form a continuous passageway through the rib 64. A second vertical bore 74 is adjacent to the front of the rib 64 and extends from a lower surface of the rib 64 upwardly to a position where it intersects with the longitudinal bores 72*a* and 72*b*. Both longitudinal bores 72*a* and 72*b* have ends plugged at 70. An exit port for the high pressure condensate is defined at 76.

The bores 68, 72*a*, 72*b* and 74 provide a continuous heating passageway for heating the strengthening ribs 64. In this manner, the strengthening ribs 64 are maintained at substantially the same temperature as the plate 16 to ensure that the strengthening ribs 64 expand consistently with the expansion of the heating plate 16.

Referring again to FIGS. 1 and 2, the holddown device 28 of the double facer 10 is shown as a weighted blanket 78 pressing against the double face web 24 to facilitate heat transfer from the heating plates 16. The double face web 24 is pulled through the double facer 10 by the downstream drawing section 14. As the double face web 24 is moved in the direction of arrow 30 as shown in FIGS. 1 and 2, the combination of heat, from the heating plates 16, and the pressure, imparted upon the web by the blanket 78, gelatinizes the glue between the bottom liner 22 and single face web 20 to form bonded double face corrugated paperboard 24.

Figure 11:
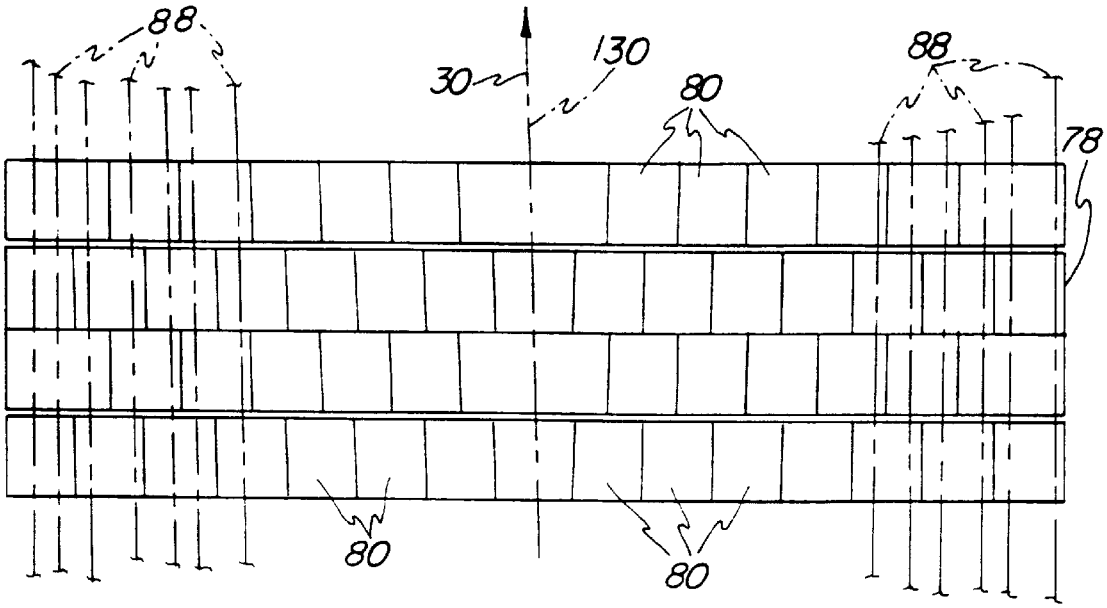
FIG. 11 is a partial top plan view of the weight blanket of the present invention as used in FIG. 1 with a portion of the cables removed for clarity.
Figure 12:
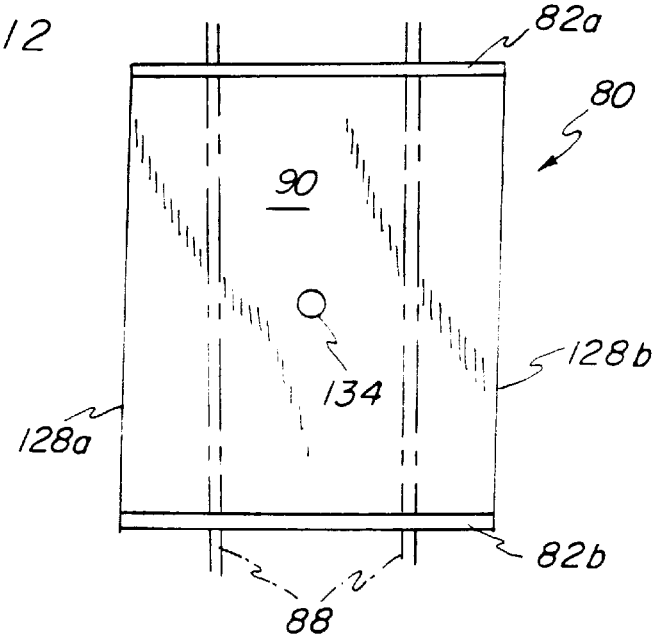
FIG. 12 is a top plan view of a rigid shoe of the present invention.
Figure 13:
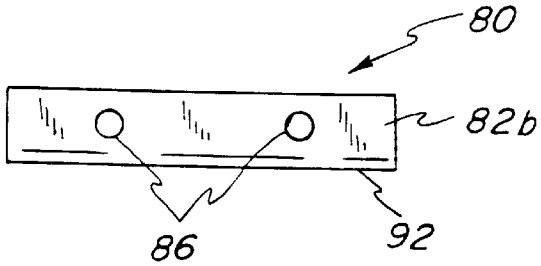
FIG. 13 is a front elevational view of a rigid shoe of the present invention.

Referring now to FIGS. 3 and 11–16, the weight blanket 78 includes a plurality of rigid shoes 80 formed of bent sheet metal. Each shoe 80 includes first and second lips 82*a* and 82*b* defining a U-shaped body portion 84 (FIG. 12). Both the first and second lips 82*a* and 82*b* are formed with a pair of apertures 86 for receiving support cables 88 (FIG. 13). The shoes 80 have an upper surface 90 and a lower surface 92 wherein the lower surface 92 faces the double face web 24 as illustrated in FIG. 3. In the preferred embodiment, each shoe 80 is formed of 0.25 inch stainless steel plate bent to a length of 8.0 inches and a width of 6.5 inches.

The shoes 80 are arranged in an offset pattern in the direction of web travel, as indicated by arrow 30 in FIG. 11, and are interconnected by a series of the metal cables 88 threaded through the apertures 86 formed within the first and second lips 82*a* and 82*b* of each shoe 80. As illustrated in FIGS. 1 and 2, the upstream and downstream ends 94 and 96 of each cable 88 are supported by upstream and downstream support members or drums, 98 and 100, respectively, such that the plurality of shoes 80 are suspended above the heating plates 16. A curve or catenary of the cables 88 between the support members 98 and 100 permits the shoes 80 to force the web 24 towards the heating plates 16 thereby facilitating heat transfer therebetween.

The upstream and downstream support members 98 and 100 may be mounted for vertical movement, as indicated by arrows 102 and 104 in FIG. 1. By raising one or both of the support members 98 and 100, the respective ends 94 and 96 of the cables 88 are likewise raised to vary the portion of the blanket 78 exerting pressure against the web 24. The amount of heat transferred from the heating plates 16 to the web 24 may therefore by adjusted. Additionally, the blanket 78 may be elevated to provide clearance for threading the leading edge of the web 24 as described hereinafter with reference to FIG. 17. It should be noted that a spring (not shown) connects the downstream ends 96 of the cables 88 to the downstream support member 100 for tensioning the cables 88 to counteract cable displacement as the weight blanket 78 is lifted to adjust coverage.

Each support member 98 and 100 has opposing ends 106 and 108 operably connected to linear actuators, preferably conventional lifting screws 110. More particularly, and with reference to FIG. 15, a lifting nut 112 is fixed to a bracket 114 located at each opposing end 106 and 108 of the support members 98 and 100. Activation of a motor 116 drives a pair of the lifting screws 110 in rotation thereby raising or lowering the respective lifting nuts 112 and support member 98 and 100. It should be noted that the lifting screws 110 on opposing ends 106 and 108 of the support members 98 and 100 are both driven in synchronization by the motor 116 which rotates a transmission shaft 118 extending laterally, or in the cross machine direction, across the double facer 10 in parallel relation to the support members 98 and 100 (FIG. 2).

Figure 15:
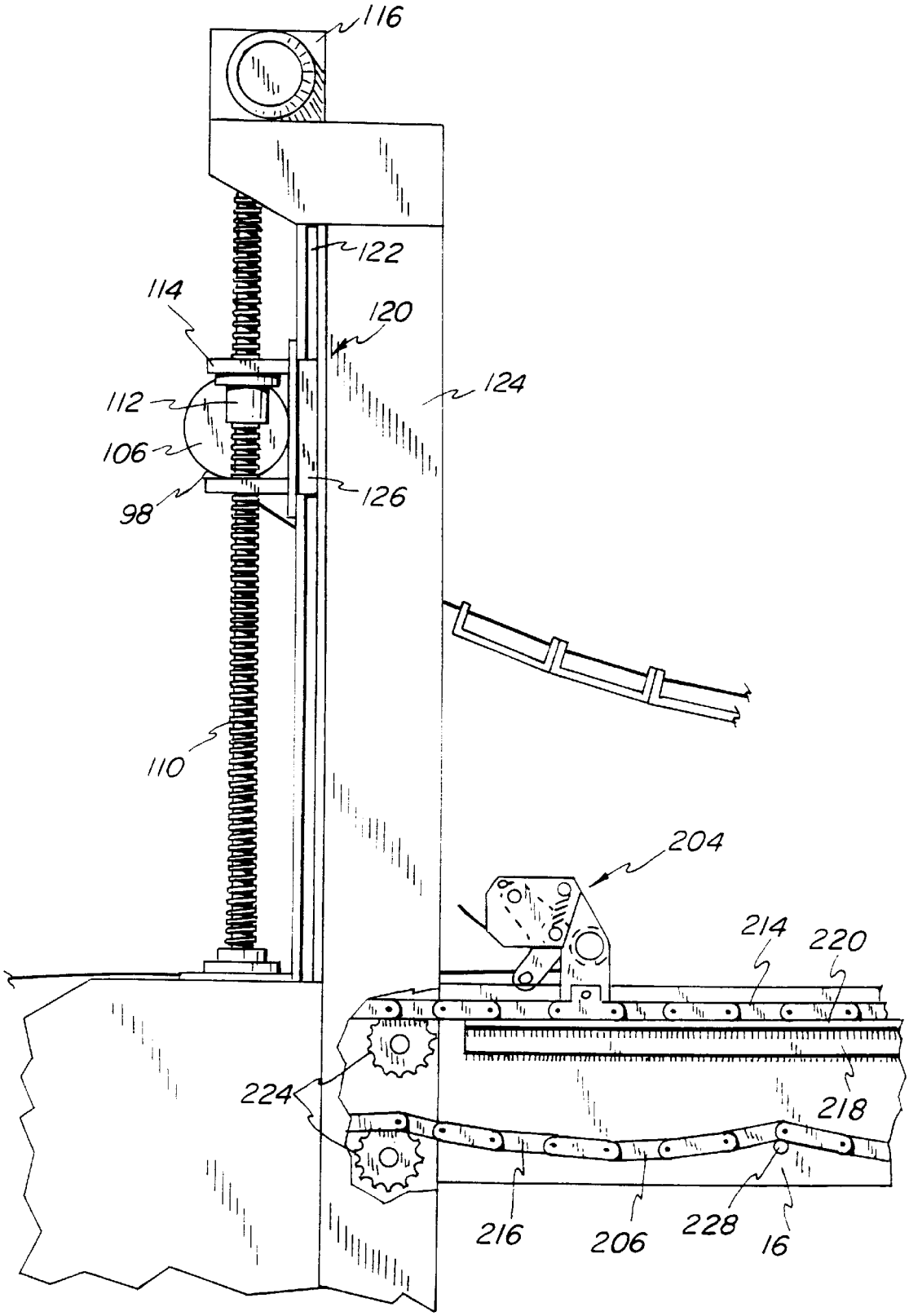
FIG. 15 is a side elevational view of the weight blanket lifting means of the present invention.

Referring further to FIG. 15, a linear rail guide 120 is located adjacent each lifting screw 110 for guiding the support members 98 and 100 in vertical movement. The linear rail guide 120 includes a rail member 122 supported on a lifting tower 124 and a guide block 126 engaging the rail member 122. Each guide block 126 is fixed to one of the brackets 114 so that, as the respective support member 98 and 100 is vertically moved, its motion is guided linearly along the rail member 122.

It is preferred that the side edges 128*a* and 128*b* of each shoe 80 be disposed at a slight angle to each adjacent lip 82*a* and 82*b* as seen in FIGS. 11 and 12. The shoes 80 are arranged such that the side edges 128*a* and 128*b* are angled outwardly from a longitudinal center axis 130 of the blanket 78 as they extend downstream in the direction of travel of the paperboard web 24, as indicated by arrow 30 in FIG. 11. The angled side edges 128*a* and 128*b* provide for improved web tracking since they tend to center the web 24 as it travels under the blanket 78. Further, the angled side edges 128*a* and 128*b* reduce scoring on the lower surface of the bottom liner 22 since the spacing between adjacent shoes 80 is not longitudinally aligned. Finally, the angled side edges 128*a* and 128*b* reduce the frequency of web tearing, once again because the web 24 is not traveling in parallel alignment to the gap between adjacent shoes 80.

While the above described heating plates 16 provide a steam film 60 to substantially reduce friction between the upper surface 34 of the heating plates 16 and the bottom liner 22, significant friction may still be produced between the stationary weight blanket 78 and the moving double face web 24. While providing a smooth lower surface 92 to the shoes 80 reduces the friction resulting between the blanket 78 and the web 24, it is preferred that fluid lubrication be utilized to substantially eliminate these frictional forces.

Figure 14:
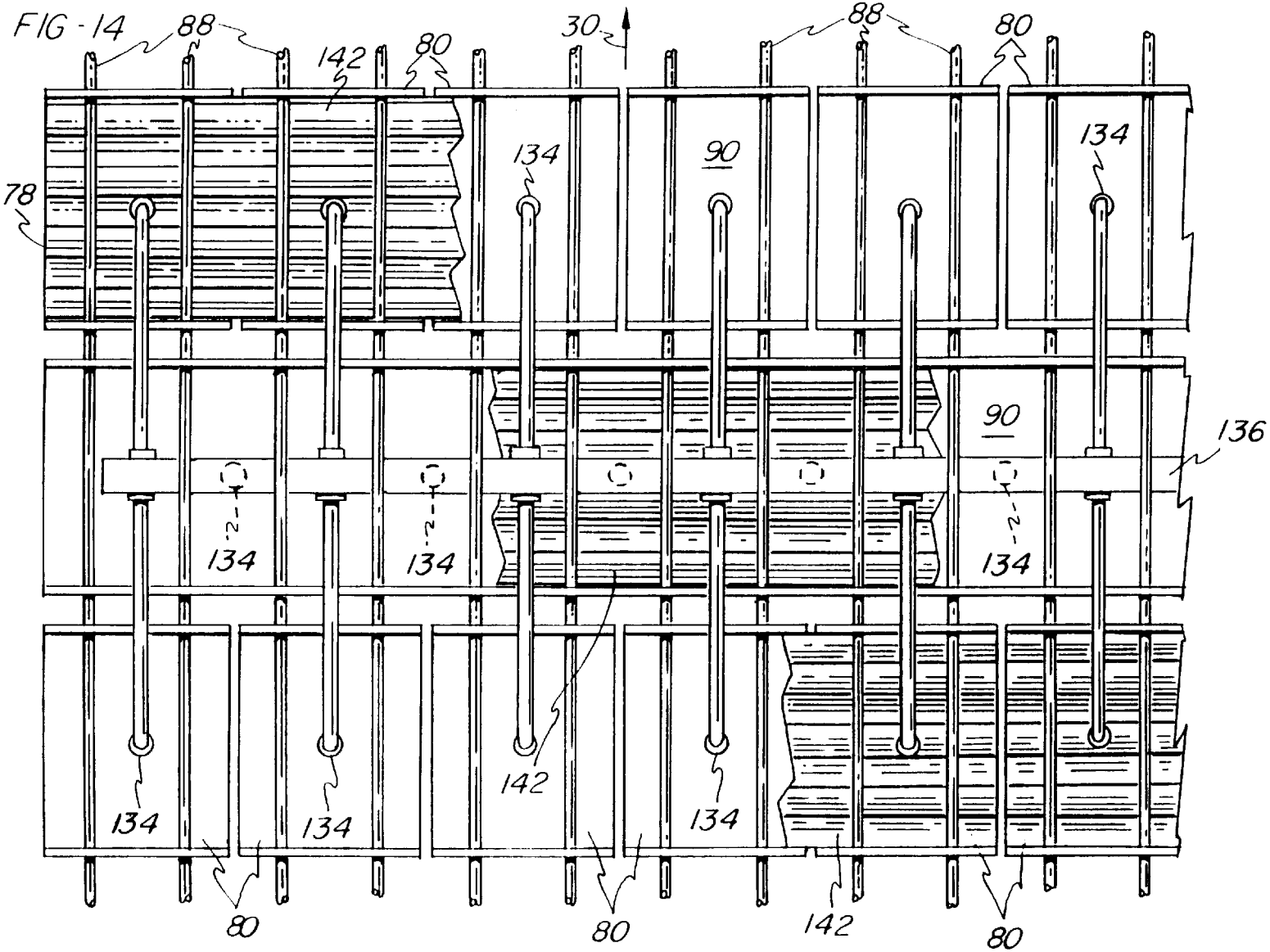
FIG. 14 is a partial top plan view of a further embodiment of the weight blanket of the present invention with a partial cutaway of the shoe heating channels.

Therefore, a further embodiment of the present invention provides for a heated fluid film 132 between the double face web 24 and the weight blanket 78. Referring now to FIGS. 3, 12 and 14, each shoe 80 has at least one fluid port 134 communicating with its lower surface 92. The fluid ports 134 are connected to a fluid manifold 136 which is in communication with a heated fluid supply (not shown). Heated fluid, preferably a low pressure dry steam, is provided to the fluid manifold 136 which distributes the steam to various fluid ports 134. The steam exits through the fluid ports 134 to form a steam film 132 between the lower surface 92 of the shoe 80 and the double face web 24. The steam film 132 substantially eliminates frictional forces between the shoe 80 and double face web 24 while providing additional heat to assist in the gelatinization of the glue between the single face web 20 and the bottom liner web 22.

A plurality of independently controllable manifolds 136 are preferably utilized such that predetermined groups of fluid ports 134 are supplied by a single manifold 136. It may be appreciated that the manifolds 136 may be arranged to distribute steam to any combination of fluid ports 134, thereby producing zones of varying steam film properties depending upon the steam supplied to each manifold 136. Therefore, a large number of different friction or temperature zones are possible depending upon the activation of different manifolds 136. These zones can be arranged to counteract and balance tension or to assist in the gelatinization of glue within the double face web 24.

Figure 16:
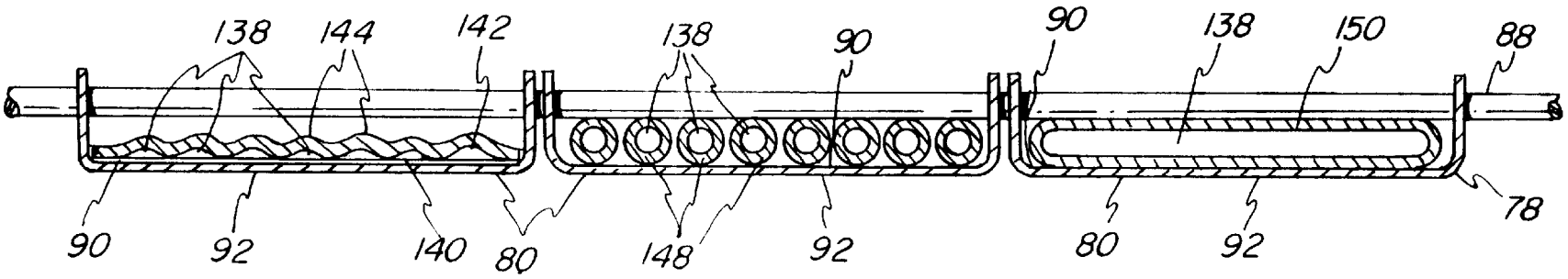
FIG. 16 is a side elevational view illustrating alternative embodiments of the shoe heating means of the present invention.

In order to prevent the steam film 132 from producing water condensate on the lower surface 92 of the shoes 80, the lower surface 92 of each shoe 80 is preferably heated. Referring to FIGS. 3, 14 and 16, the upper surface 90 of the shoes 80 are in thermal contact with a plurality of channels 138 extending in the cross-machine or lateral direction. These channels 138 may comprise any of a wide variety of forms, three of which are illustrated in FIG. 16. The preferred channel configuration is to provide a flat metal plate 140 which is welded to a corrugated metal plate 142 having flutes 144 formed therein. The voids between the flat plate 140 and corrugated plate 142 define the channels 138 into which steam is provided to heat the lower surface 92 of the shoes 80. Alternatively, the channels 138 may be defined by cylindrical tubes 148 or elongated bladders 150 which extend laterally across the upper surface of the weight blanket 78.

The method of the present invention includes injecting high pressure steam into the primary channels 38 of the heating plate 16 thereby heating the upper surface 34 of the plate 16. Superheated low pressure steam is supplied to the secondary channels 50 which is further heated through conduction by the high pressure steam within the primary channels 38. The low pressure steam is released through the outlet ports 54 within the upper surface 34 of the heating plate 16 to generate a superheated steam film 60 between the upper surface 34 and the web 24. The paperboard web 24 is at least partially supported by and conveyed over the steam film 60 whereby nominal frictional forces develop between the web 24 and the heated surface 34.

From extensive experimentation, it has been discovered that the method and apparatus of the present invention substantially reduces the friction between the paperboard web 24 and heating plates 16 by providing a steam film 60 therebetween. The reduced friction results in less drag opposing movement of the web 24 thereby reducing the power required to convey the web 24. Further, since frictional forces opposing web movement produce tension within the web 24, reduced friction results in less tension within the web 24 thereby resulting in reduced occurrences of web breakage or tear-outs.

Additionally, it has been unexpectedly discovered that the steam film 60 significantly accelerates the rise in temperature of the paperboard web 24 over the prior art method and apparatus which relies on the inherently poor thermal conduction between the heated surface of a heating plate and the paperboard web. This is particularly true when heating heavy weight paperboard. The steam film 60 dramatically improves the heating and gelatinization times of the glue between paperboard webs. Thus, processing speeds of the corrugating equipment may be increased since the paperboard does not need long heat transfer periods of time. Consequently, the steam film 60 also facilitates the processing of multi-walled paperboard webs.

It is believed that the significant benefits resulting from the use of the steam film 60 are a result of a mass transfer process including the absorption and condensation of steam in the paper and, in particular, on the glue line between webs. A large quantity of thermal energy is released upon the condensation of steam giving rise to the observed improvements in the gelatinization of the glue between webs.

It has been also discovered that the use of a steam film 60 between the heating plate 16 and paperboard web 24 results in less moisture being removed from the paperboard than with prior art heating plates alone. As such, the method and apparatus of the present invention is well-suited for use as a double facer preheater for conditioning the single face web 20 prior to entering the heating section 12 of the double facer 10. Moisture is retained within the single face web 20 resulting in less warpage as the freshly single face web 20 and bottom liner 22 approach a moisture equilibrium state after being bonded to form a double face web 24.

Figure 17:
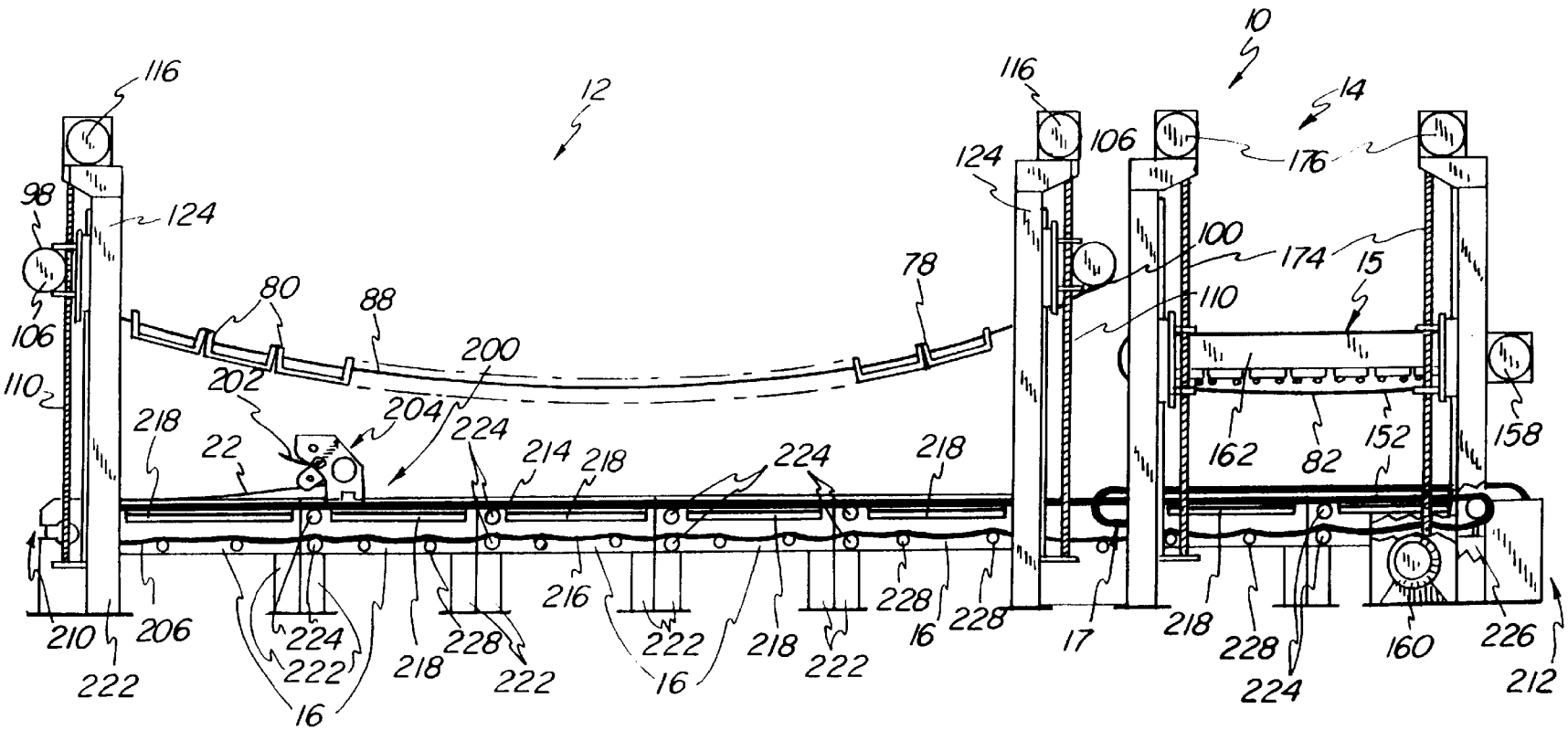
FIG. 17 is a side elevational view of a threading device of the present invention installed on a double facer.

Referring to FIGS. 1, 2 and 17, the double face web 24 is pulled through the heating section 12 by the drawing section 14 which includes upper and lower opposing continuous conveyor belts 15 and 17. Each belt 15 and 17 defines an outer surface 152 for engaging a surface 154 and 156 of the double face web 24. More specifically, in a normal mode of operation, the conveyor belts 15 and 17 define a passageway wherein the outer surfaces 152 of the upper and lower belts 15 and 17 are adapted for engaging the upper and lower surfaces 154 and 156 of the web 24, respectively. Both the upper and lower conveyor belts 15 and 17 are driven by motors 158 and 160, respectively, in a manner as is well known in the art. The motors 158 and 160 are electronically coupled to ensure that each belt 15 and 17 is driven at the same speed such that the upper and lower surfaces 154 and 156 of the web 24 are likewise driven at the same speed. This prevents a speed differential between the upper and lower surfaces 154 and 156 of the web 24 which could damage the fresh bond between the single face web 20 and the bottom liner web 22.

The upper conveyor belt 15 is supported by a vertically moveable frame 162. A plurality of weight rolls 164 are rotatably mounted within the frame 162 for exerting pressure against an inner surface 166 of the upper belt 15 thereby forcing the upper belt 15 towards the lower belt 17. The weight rolls 164 therefore facilitate frictional contact between the outer surfaces 152 of the upper and lower conveyor belts 15 and 17 and the upper and lower surfaces 154 and 156 of the web 24.

A bracket 168 is attached proximate each corner of the moveable frame 162. A lifting nut and guide block (not shown) are fixed to each bracket 168 in a manner similar to the lifting nut 112 and guide block 126 of the support members 98 and 100 as described above with reference to FIG. 15. A lifting screw 174 threadably engages the lifting nut wherein activation of a motor 176 drives the lifting screw 174 in rotation, thereby raising or lowering the lifting nut and the upper conveyor belt 15. A linear guide member (not shown) of the type described above with respect to FIG. 15 is provided wherein the guide block engages a rail member (not shown) fixed to a lifting tower 182. The linear guide member ensures that the moveable frame 162 is raised in substantially linear vertical movement. A single motor 176 operates a pair of lifting screws 174 by rotating a laterally extending transmission shaft 184 between the pair of lifting screws 174 (FIG. 2).

Turning now to FIGS. 2, 15 and 17, a web threading device 200 is illustrated for threading a lead edge 202 of the bottom liner 22 through the double facer 10 of the present invention. The web threading device 200 includes a gripping device 204 supported between a pair of flexible conveyor elements, preferably roller chains 206 and 208. The roller chains 206 and 208 extend downstream from proximate an entrance end 210 to proximate an exit end 212 of the double facer 10 along each side thereof. Each chain 206 and 208 has an upper run 214 and a lower run 216 wherein the upper run 214 is partially supported by support rails 218 having a nylon bearing strip 220 for contacting a respective roller chain 206 and 208 (FIG. 15). Each support rail 218 is located exterior to the heating plates 16 and between adjacent support legs 222 for the heating plates 16. Idler sprockets 224 are located between each support rail 218 for guiding the upper and lower runs 214 and 216 of each chain 206 and 208 when it is driven in motion by a motor 226 located proximate the exit end 212 of the double facer 10. A plurality of support pins 228 are positioned between the idler sprockets 224 below the support rails 218 for supporting the lower run 216 of each roller chain 206 and 208. When the motor 226 is activated, the chains 206 and 208 and gripping device 204 are driven longitudinally through the double facer 10.

Figure 18:
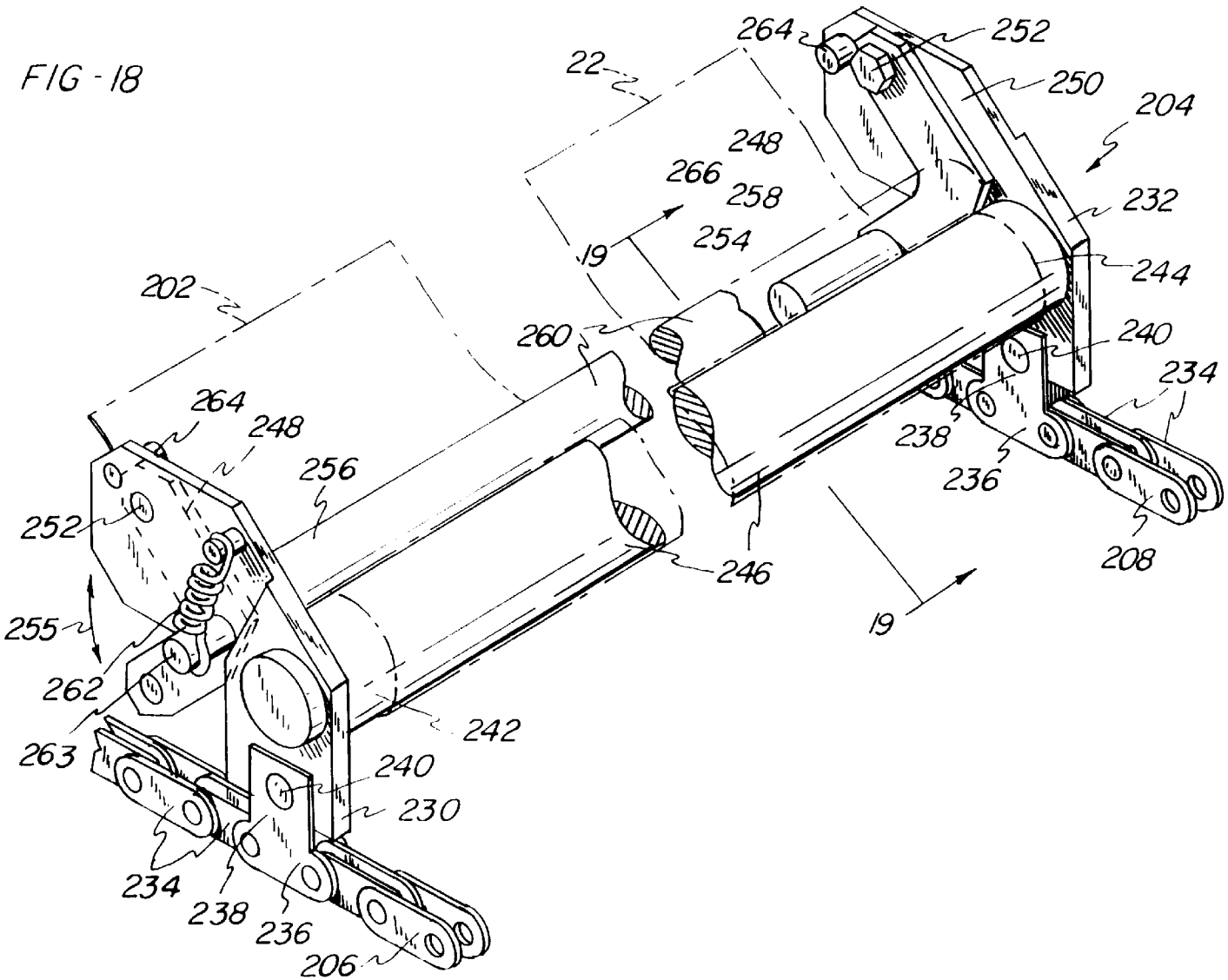
FIG. 18 is a perspective view of the gripping device of the present invention.
Figure 19:
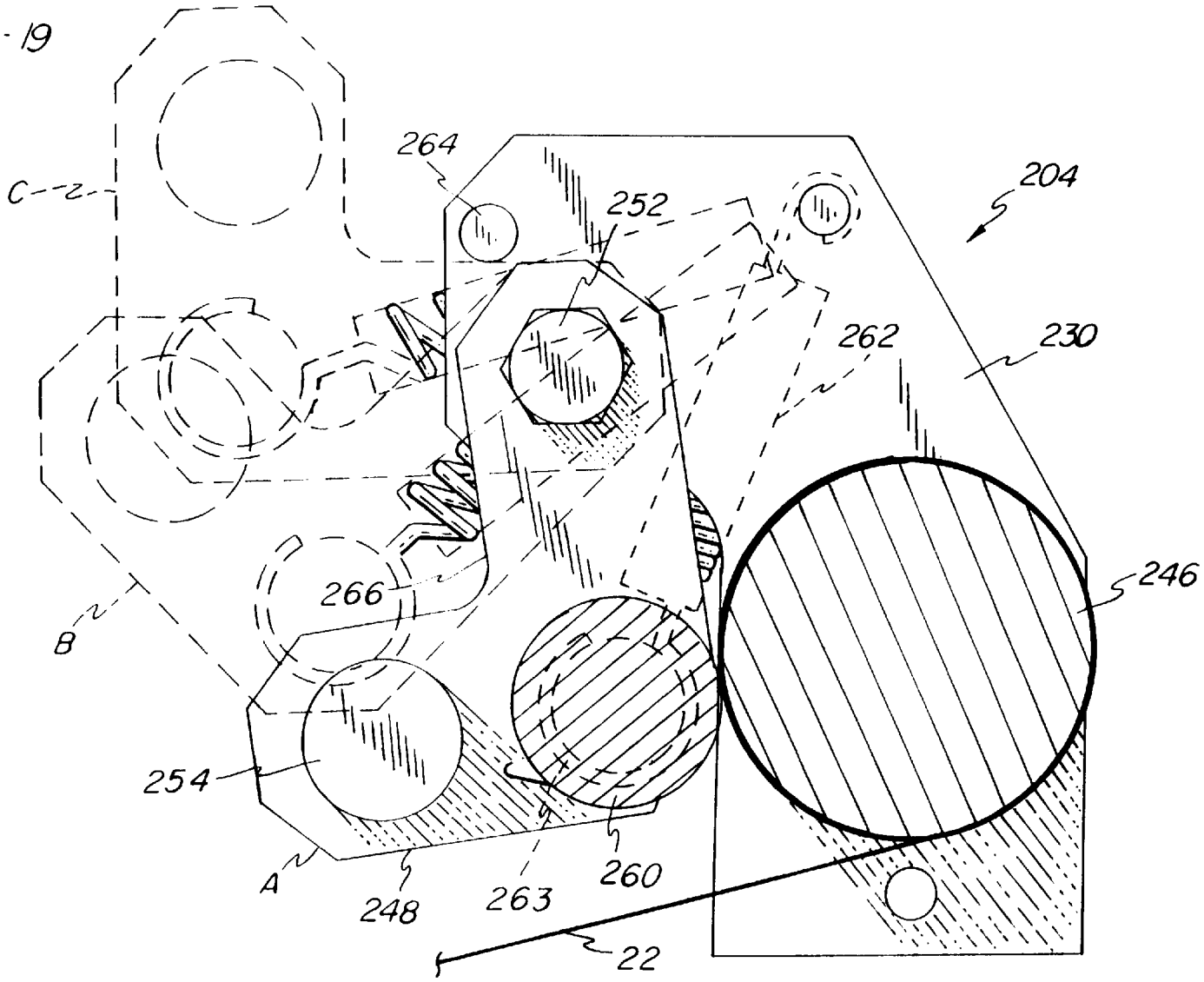
FIG. 19 is a cross-sectional view taken along line 19—19 of FIG. 18 illustrating various positions of the pivot arm of the present invention.

Referring to FIGS. 18 and 19, the gripping device 204 includes a pair of mounting plates 230 and 232, each mounted to one of the roller chains 206 and 208. One of the roller chain links 234 is replaced by a mounting link 236 having outwardly extending tabs 238 which straddle one of the mounting plates 230 and 232. A pin 240 secures the tabs 238 a respective mounting plate 230 and 232. Opposing ends 242 and 244 of a threader bar 246 are secured to mounting plates 230 and 232, respectively, wherein the threader bar 246 extends in a lateral or cross machine direction across the double facer 10 between the conveyor chains 206 and 208. A pivot arm 248 is pivotally mounted to an inside surface 250 of each mounting plate 230 and 232 by a pivot bolt 252. The pivot arm 248 includes a handle 254 fixed thereto for utilization by an operator in pivoting the pivot arm 248 about the pivot bolt 252 as indicated in FIG. 18 by arrow 255.

Opposing ends 256 and 258 of a pinch bar 260 are supported by each pivot arm 248 wherein the pinch bar 260 is selectively engagable with the threader bar 246. A spring 262 connects the pivot arm 248 with respective mounting plate 230 and 232 for biasing the pinch bar 260 towards the threader bar 246 during a normal mode of operation, which is represented by reference letters A and B in FIG. 19. When the spring 262 travels "over center", i.e. to a position where a spring connection point 263 on the pivot arm 248 is above the pivot bolt 252 as represented by reference letter C in FIG. 19, a set-up mode of operation is defined. In this set-up mode of operation, the pinch bar 260 is biased away from the threader bar 246 and remains locked in an open position. The clockwise movement of the pivot arm 248 and pinch bar 260, as shown in FIG. 19, is limited by a stop pin 264 which engages a bearing surface 266 of the pivot arm 248.

In operation, the operator first elevates the weight blanket 78 and upper conveyor belt 15 to provide adequate clearance for the gripping device 204 to move longitudinally through the double facer 10 as illustrated in FIG. 17. As described above, the upstream and downstream support members 98 and 100 for the blanket cables 88 are operably connected to lifting screws 110. The motors 116 are activated to rotate the lifting screws 110 and raise the support members 98 and 100 to a position where the gripping device 204 will clear the catenary of the weight blanket 78. Similarly, the lifting screws 174 for supporting the moveable frame 162 of the upper conveyor belt 15 are rotated thereby raising the upper conveyor belt 15 such that the gripping device 204 will clear the upper conveyor belt 15.

Once the weight blanket 78 and upper conveyor belt 15 are elevated, the operator positions the gripping device 204 adjacent the entrance end 210 of the double facer 10 by selective activation of the motor 226 driving the roller chains 206 and 208. Next, the operator pulls the handle 254 and pivot arm 248 of the gripping device 204 upwardly thereby pivoting the pinch bar 260 away from the threader bar 246 until the pivot arm 248 engages the stop pin 264. At this point, the pinch bar 260 is locked open in the set-up mode of operation. The leading edge 202 of the bottom liner 22 is then pulled towards the gripping device 204 and wrapped from beneath the threader bar 246 upwardly around a substantial portion of an outer surface 268 of the threader bar 246 until positioned for clamping engagement between the threader bar 246 and the pinch bar 260.

The operator next pulls the handle 254 downwardly towards the threader bar 246 so that the pivot arm 248 travels "below center", i.e. where the spring connection point 263 of the pivot arm 248 is below the pivot bolt 252. This returns the gripping device 204 to its normal mode of operation wherein the pinch bar 260 is spring biased towards the threader bar 246. As clearly illustrated in FIG. 19, the bottom liner web 22 is locked between the pinch bar 260 and the threader bar 246 at this point. The operator activates the motor 226 which drives the roller chains 206 and 208, along with the gripping device 204 and web 22, downstream through the heating section 12 and drawing section 14 of the double facer 10. The motor 226 is stopped once the gripping device 204 is located proximate the exit end 212 of the double facer 10. The operator pulls the handle 254 upwardly and away from the threader bar 246 until the pivot arm 248 engages the stop pin 264 and is locked open in the set-up mode of operation.

The paperboard web 22 is then unwrapped from the outer surface 268 of the threader bar 246 and the gripping device 204 conveyed just beyond the exit end 212 of the double facer 10 where it will not interfere with the continuous processing of the double face web 24. The weight blanket 78 and upper conveyor belt 15 are then lowered to the positions illustrated in FIG. 1. The single face web 20 having glued flute tips is brought into adhering contact with the bottom liner web 22. The drawing section 14 is activated to pull the webs 20 and 22 together through the heating section 12 to form the double face web 24.

Figure 20:
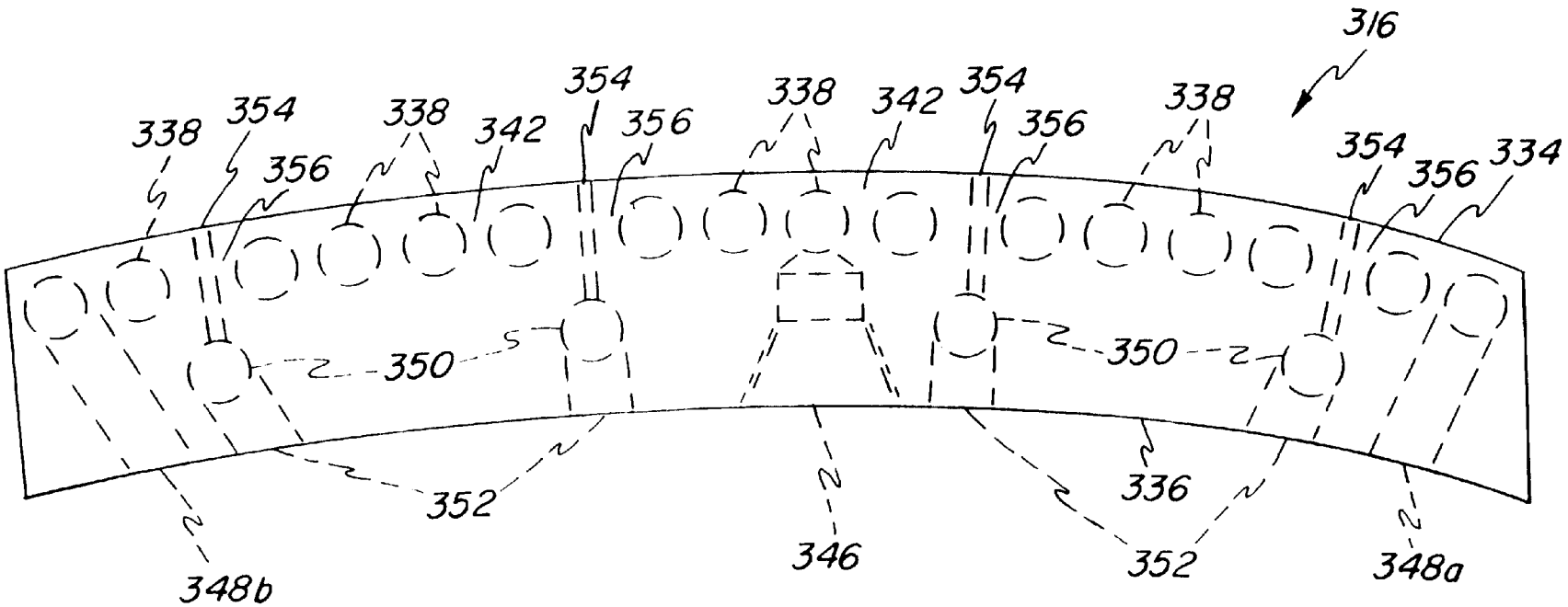
FIG. 20 is a side elevational view of a further embodiment of the present invention where the heating plate is of an arcuate configuration.

Turning now to FIG. 20, an alternative embodiment of the present invention is illustrated as a heating plate 316 configured with an arcuate heated or upper surface 334 for facing a web and a lower surface 336 for facing away from the web. A plurality of primary channels 338 extend between opposite sides of the plate 316 and are formed by drilling through the plate 316 from side to side, thereby forming walls 342 between the primary channels 338. The heating plate 316 further includes slots to interconnect adjacent channels 338 at alternate ends to form a serpentine path therethrough as with the embodiment of FIGS. 4–8.

The serpentine path defined by the channels 338 is provided with a high pressure steam inlet port 346 and high pressure condensate return ports 348*a* and 348*b*, whereby steam may be provided to and removed from the interior of the plate 316, within the serpentine path, to maintain the heating plate 316 at a desired temperature. The steam inlet and return ports 346 and 348 may be provided at alternative locations in the plate 316 to provide for flexibility in interconnecting with external steam piping.

The heating plate 316 further includes a plurality of secondary channels 350 extending parallel to the primary channels 338 between the side faces, and located intermediate the primary channels 338 and the lower surface 336. Each secondary channel 350 is cylindrical in nature and is sealed from the other channels 348 and 350 within the plate 316. A low pressure steam inlet port 352 communicates with each secondary channel 350 and may be located at any convenient location in the plate 316 to facilitate connections with external steam piping. Some of the primary channels 338 are spaced farther apart than others thereby forming a thickened wall 356 for supporting a plurality of fluid ports 354.

Low pressure steam supplied to the secondary channels 350 through the inlet port 352 will be superheated through heat transfer from the primary channels 338 and then exit through the fluid ports 354 to the upper surface 334 of the plate 316. A steam film is thereby produced between the upper surface 334 and the corrugated web for supporting the web above the heating plate 316 in the same manner as with the embodiment of FIGS. 4–8.

Figure 21:
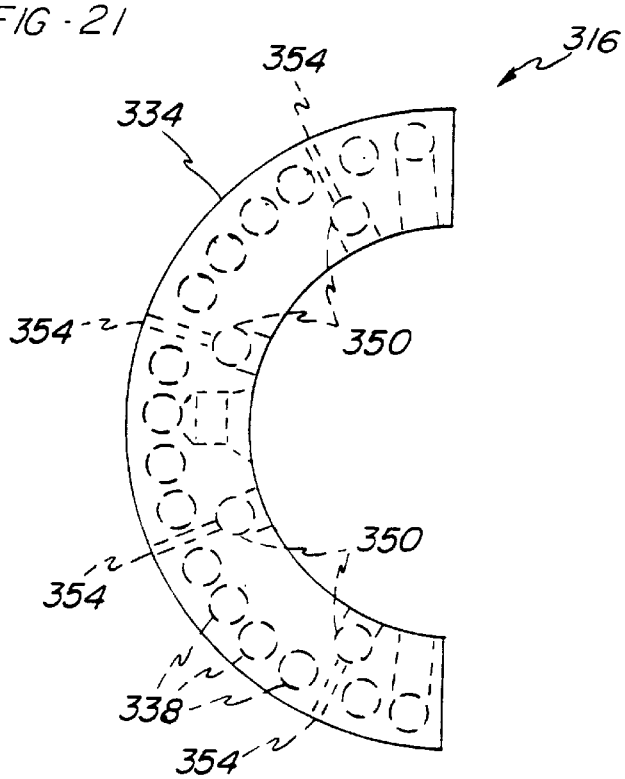
FIG. 21 is a side elevational view of a further embodiment of the present invention where the heating plate is of a half round configuration.

It is readily apparent from FIGS. 20 and 21, that the radius of curvature of the arcuate upper surface 334 may be modified as necessary to meet equipment specifications or operating conditions. As such the heating plate 316 may be adapted for use in existing single facers as a preheater for medium and liner webs.

Figure 22:
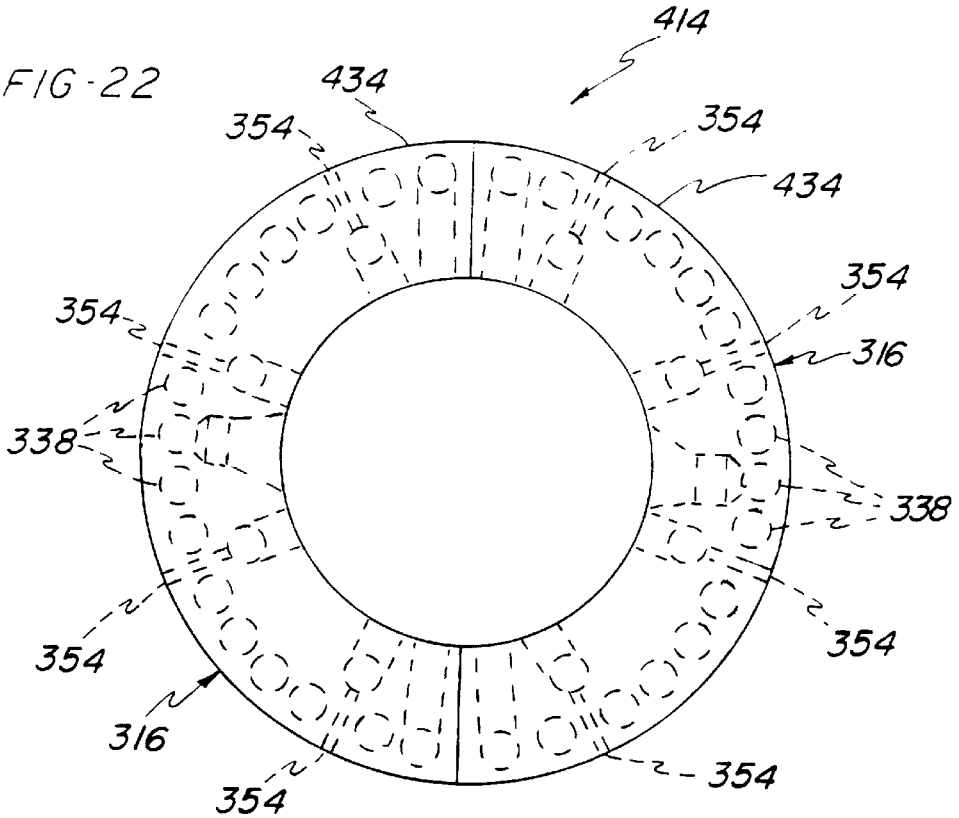
FIG. 22 is a side elevational view of a further embodiment of the present invention where the heating plate is of a full cylindrical configuration.

Referring now to FIG. 22, two identical heating plates 316 may be joined to form a single cylindrical heating plate 416. Alternatively, the heating plate 416 may be comprised of an integral cylindrical tube, with the primary and secondary channels 338 and 350 drilled through the tube in the desired pattern. This plate 416 is particularly well suited for use as a preheater for heating liner paper or single face web approaching the double facer 10. The paperboard would be drawn over the heating plate 416 across its outer cylindrical surface 434. Once again ports 454 would produce a steam film for reducing friction between the surface 434 and the traveling paperboard web 24 while assisting in the gelatinization of the glue within the web.

It is also envisioned that the heating plate 416 may cooperate with a corrugating roll in a single facer for facilitating the rapid gelatinization of the glue between the medium and liner webs. The heating plate 416 could be used in conjunction with prior art single facer pressure applicators or as an independent unit acting as a pressure member for pressing the medium and liner webs together in bonding engagement. The low pressure steam exiting the fluid ports 454 would at least partially pass through the liner web to the glue on the flute tips of the medium web, thereby quickly curing the glue and forming a bond between the webs. Such a rapidly forming bond would dramatically reduce the amount of pressure needed between the webs to provide effective bonding, resulting in a single face web with an improved appearance and fewer occurrences of web breakage.

While the method herein described, and the forms of apparatus for carrying this method into effect, constitute preferred embodiments of this invention, it is to be understood that the invention is not limited to these precise method and forms of apparatus, and that changes may be made in either without departing from the scope of the invention, which is defined in the appended claims.

What is claimed is:

1. An apparatus in which a liner paperboard web is heated and brought into adhering contact with adhesive placed on flutes of a single face paperboard web thereby forming a double face paperboard web, said apparatus comprising:

a plurality of heating plates defining a substantially planar heated surface facing a lower surface of said liner paperboard web and a remote surface facing away from said liner paperboard web;

a heating element in thermal communication with said heated surface for heating said heated surface;

a holddown device positioned above said heated surface for applying pressure against an upper surface of said single face paperboard web;

a passageway for receiving said liner paperboard web and said single face paperboard web, said passageway defined between said heated surface and said holddown device;

a plurality of ports formed within said heated surface and below said holddown device, said plurality of ports in fluid communication with said passageway;

a steam source in fluid communication with said plurality of ports;

a steam film produced by said plurality of ports and located in said passageway intermediate said heated surface and said liner paperboard web; and wherein said steam film at least partially lubricates said liner paperboard web from frictional contact with said heated surface by forcing said liner paperboard web away from said heated surface, while simultaneously supplying heat to said double face paperboard web.

2. The apparatus of claim 1 wherein each said heating plate includes:

an upper surface defining said heated surface;

a lower surface in spaced relation to said upper surface and defining said remote surface;

a plurality of primary channels defining said heating element and extending through said plate proximate said upper surface and in substantially parallel relation to each other;

a plurality of secondary channels extending through said plate in spaced relation to said primary channels and said lower surface; and wherein said secondary channels provide fluid communication between said upper surface through said ports and said steam source.

3. The apparatus of claim 2 wherein said primary channels and secondary channels are supplied with steam.

4. The apparatus of claim 3 wherein said primary channels are in fluid communication with a source of high pressure steam and said secondary channels are in fluid communication with a source of low pressure steam, said high pressure steam having a pressure substantially greater than a pressure of said low pressure steam, wherein said high pressure steam heats said upper surface through conduction and said low pressure steam exits said secondary channels through said ports thereby forming said steam film.

5. The apparatus of claim 4 further comprising means for superheating said low pressure steam before exiting through said ports.

6. The apparatus of claim 1 wherein said double face paperboard web is at least partially supported by said steam film.

7. The apparatus of claim 1 wherein selected ones of said ports are independently controllable for producing zones of varying pressures and temperatures within said steam film.

8. The apparatus of claim 1 further comprising a drawing section positioned downstream from said heating plates for pulling said double face paperboard web over said heated surface.

9. The apparatus of claim 8 wherein said drawing section comprises upper and lower opposing conveying elements facing upper and lower surfaces of said double face paperboard web, said upper conveying element vertically movable relative said lower conveying element.

10. The apparatus of claim 9 further comprising a linear actuator for raising and lowering said upper conveying element.

11. The apparatus of claim 1 wherein said holddown device further comprises a plurality of ports in fluid communication with a steam source and producing a steam film between an upper surface of said double face paperboard web and a lower surface of said holddown device wherein said holddown device is at least partially supported by said steam film, and said upper and lower surfaces of said double face paperboard web are at least partially lubricated from frictional contact with said heated surface of said heating plates and said lower surface of said holddown device.

12. The apparatus of claim 11 wherein said holddown device further comprises a plurality of channels in communication with a fluid source supplying a heated fluid wherein a lower surface of said holddown device is heated by said heated fluid.

13. The apparatus of claim 1 wherein said plurality of ports are supplied with a low pressure steam having a pressure less than 160 psig.

14. A heating device for a web, said heating device comprising:

at least one heating plate defining a heated surface facing said web and a remote surface facing away from said web;

means for heating said heated surface of said at least one heating plate;

a plurality of ports positioned within said heated surface and positioned below said web, said plurality of ports sealed from fluid communication with said means for heating said heated surface;

means for supplying a steam to said plurality of ports; and a steam film produced by said plurality of ports and positioned between said heated surface of said plate and said web, said steam film at least partially lubricating said web from frictional contact with said heated surface by forcing said web away from said heated surface, while simultaneously supplying heat to said web.

15. The heating device of claim 14 wherein said means for heating said heated surface of said heating plate comprises:

a plurality of primary channels extending through said plate proximate said heated surface and in substantially parallel relation to each other;

a first steam inlet port in fluid communication with said primary channels; and a steam source in fluid communication with said first steam inlet port for supplying a steam to said plurality of primary channels.

16. The heating device of claim 15 wherein said means for supplying a steam to said plurality of ports comprises:

a plurality of secondary channels extending through said plates in spaced relation to said primary channels and said remote surface;

a second steam inlet port in fluid communication with said secondary channels;

wherein said steam source is in fluid communication with said second steam inlet port for supplying a steam to said plurality of said secondary channels; and a plurality of outlet ports providing fluid communication between said secondary channels and said heated surface of said plate.

17. The heating device of claim 14, wherein said heated surface is substantially planar.

18. The heating device of claim 14, wherein said heated surface is arcuate.

19. The heating device of claim 14, wherein said heated surface is defined by a plurality of heating plates.

20. A heating device for a web, said heating device comprising:

at least one heating plate defining a heated surface facing said web and a remote surface facing away from said web;

a heating element in thermal communication with said heated surface of said at least one heating plate;

a plurality of outlet ports positioned within said heated surface of said plate and positioned below said web;

a steam source for supplying steam to said plurality of outlet ports;

a steam film produced by said plurality of outlet ports and located above said heated surface of said plate and below said web; and wherein said steam film at least partially lubricates said web from frictional contact with said heated surface by forcing said web away from said heated surface, while simultaneously supplying heat to said web.

21. The heating device of claim 20 wherein said heating element comprises:

a plurality of primary channels extending through said plate proximate said heated surface and in substantially parallel relation to each other;

a first steam inlet port in fluid communication with said primary channels; and wherein said steam source is in fluid communication with said first steam inlet port for supplying steam to said plurality of primary channels.

22. The heating device of claim 21 further comprising:

a plurality of secondary channels extending through said plates in spaced relation to said primary channels and said remote surface;

a second steam inlet port in fluid communication with said secondary channels;

said steam source in fluid communication with said second steam inlet port for supplying steam to said plurality of secondary channels; and wherein said plurality of ports provide fluid communication between said secondary channels and said heated surface of said plate.

23. The heating device of claim 22 wherein said steam source supplies said second steam inlet port and said secondary channels with low pressure steam which exits said secondary channels through said plurality of outlet ports thereby forming said steam film and said steam source supplies said first steam inlet port and said primary channels with high pressure steam, said high pressure steam having a pressure greater than a pressure of said low pressure steam.

24. The heating device of claim 23 further comprising means for superheating said low pressure steam before exiting through said plurality of outlet ports.

25. The heating device of claim 20 further comprising a holddown device positioned above said heated surface for applying pressure against an upper surface of said web.

26. The heating device of claim 25 wherein said holddown device includes a plurality of ports in fluid communication with a steam source and producing a steam film between an upper surface of said web and a lower surface of said holddown device wherein said holddown device is at least partially supported by said steam film, and said upper and lower surfaces of said web are at least partially lubricated from frictional contact with said heated surface of said heating plates and said lower surface of said holddown device.

27. The heating device of claim 26 wherein said holddown device further comprises a plurality of channels in communication with a fluid source supplying a heated fluid wherein a lower surface of said holddown device is heated by said heated fluid.

28. The heating device of claim 20, wherein said heated surface is substantially planar.

29. The heating device of claim 20, wherein said heated surface is arcuate.

30. The heating device of claim 20, wherein said heated surface is defined by a plurality of heating plates.

* * * * *

UNITED STATES PATENT AND TRADEMARK OFFICE

CERTIFICATE OF CORRECTION

PATENT NO. : 6,110,095

DATED : August 29, 2000

INVENTOR(S) : Finke et al.

It is certified that error appears in the above-identified patent and that said Letters Patent are hereby corrected as shown below:

On the cover page, at item 75, delete the following: "Gary S. Podhorniak, Baltimore;"

Signed and Sealed this

Seventeenth Day of April, 2001

*Attest:*

Nicholas P. Godici

NICHOLAS P. GODICI

*Attesting Officer*

*Acting Director of the United States Patent and Trademark Office*